US007770561B2

(12) United States Patent
Kojima et al.

(10) Patent No.: US 7,770,561 B2
(45) Date of Patent: Aug. 10, 2010

(54) INTERNAL COMBUSTION ENGINE

(75) Inventors: Susumu Kojima, Susono (JP); Fumiaki Hattori, Mishima (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 0 days.

(21) Appl. No.: 12/308,191

(22) PCT Filed: Dec. 21, 2007

(86) PCT No.: PCT/IB2007/004081

§ 371 (c)(1),
(2), (4) Date: Dec. 9, 2008

(87) PCT Pub. No.: WO2008/078173

PCT Pub. Date: Jul. 3, 2008

(65) Prior Publication Data

US 2009/0320796 A1 Dec. 31, 2009

(30) Foreign Application Priority Data

Dec. 22, 2006 (JP) ..... 2006-346098

(51) Int. Cl.
*F02B 7/02* (2006.01)
*F02B 7/00* (2006.01)

(52) U.S. Cl. ..... 123/431; 123/299; 123/304

(58) Field of Classification Search ..... 123/447, 123/456, 299, 304, 514, 431, 506, 508, 510
See application file for complete search history.

(56) References Cited

U.S. PATENT DOCUMENTS

| | | | | |
|---|---|---|---|---|
| 6,742,503 | B2 * | 6/2004 | Feucht | 123/446 |
| 2005/0098155 | A1 * | 5/2005 | Yamazaki et al. | 123/431 |
| 2006/0000455 | A1 | 1/2006 | Kurata et al. | |
| 2006/0207555 | A1 | 9/2006 | Ito et al. | |

FOREIGN PATENT DOCUMENTS

| | | |
|---|---|---|
| JP | B2-2874082 | 3/1999 |
| JP | A-2004-316460 | 11/2004 |
| JP | A-2005-106027 | 4/2005 |
| JP | A-2005-351144 | 12/2005 |
| JP | A-2006-144628 | 6/2006 |
| JP | A-2006-144666 | 6/2006 |

* cited by examiner

OTHER PUBLICATIONS

Hauri, "Lexus et l'injection puissance 2," *REVUE AUTOMOBILE*, Jul. 27, 2006, pp. 11.

*Primary Examiner*—Mahmoud Gimie
(74) *Attorney, Agent, or Firm*—Oliff & Berridge PLC

(57) ABSTRACT

An internal combustion engine includes a low-pressure fuel feed system that feeds low-pressure fuel pressurized by a feed pump to first delivery pipes through a low-pressure fuel feed pipe, first injectors capable of injecting the low-pressure fuel into intake ports, a high-pressure fuel feed system that feeds high-pressure fuel pressurized by a high-pressure pump to second delivery pipes through a high-pressure fuel feed pipe, and second injectors capable of injecting the high-pressure fuel into combustion chambers. A bypass passage communicates the first delivery pipe with the second delivery pipe, and a check valve is provided in the bypass pipe for preventing flow of the fuel from the second delivery pipe to the first delivery pipe. Thus, transmission of fuel pressure pulsation caused by driving of the high-pressure pump is effectively restricted, so that an appropriate amount of fuel can be supplied to the engine for improved control of the air/fuel ratio.

18 Claims, 7 Drawing Sheets

INTERNAL COMBUSTION ENGINE

INCORPORATION BY REFERENCE

The disclosure of Japanese Patent Application No. 2006-346098 filed on Dec. 22, 2006, including the specification, drawings and abstract is incorporated herein by reference in its entirety.

BACKGROUND OF THE INVENTION

1. Field of the Invention

The invention relates to an internal combustion engine, and more particularly to an internal combustion engine having a low-pressure fuel feed system that feeds or supplies low-pressure fuel, low-pressure fuel injection devices capable of injecting the low-pressure fuel into intake ports, a high-pressure fuel feed system that feeds or supplies high-pressure fuel, and high-pressure fuel injection devices capable of injecting the high-pressure fuel into combustion chambers.

2. Description of the Related Art

As one type of internal combustion engine, such as a gasoline engine or a diesel engine, installed on a vehicle, such as a passenger automobile or a truck, a direct or in-cylinder injection type internal combustion engine in which fuel is directly injected into combustion chambers (cylinders) rather than intake ports is known in the art. In the direct injection type internal combustion engine, when an intake valve is opened, air is drawn from a corresponding intake port into a combustion chamber, and a fuel injection valve (injector) directly injects fuel into the combustion chamber during the intake stroke or during the compression stroke on which a piston is elevated so as to compress the intake air. As a result, high-pressure air and mist-like fuel are mixed with each other, and the resulting fuel-air mixture is fired by an ignition plug, to explode in the combustion chamber. Then, exhaust gas is discharged through an exhaust port when an exhaust valve is opened.

In a fuel system of the direct injection type internal combustion engine as described above, an electrically operated, low-pressure fuel pump pumps up the fuel in a fuel tank and raises the pressure of the fuel to a given low pressure, and a high-pressure fuel pump raises the pressure of the low-pressure fuel to provide high-pressure fuel. The high-pressure fuel is then stored in a delivery pipe, and a plurality of fuel injection valves (injectors) mounted on the delivery pipe inject the fuel in the form of particles into the respective combustion chambers. In the high-pressure pump, a plunger is driven by cams that rotate with the crankshaft, to move up and down or reciprocate so as to raise the pressure of the fuel. In this case, the reciprocating motion of the plunger has a suction stroke in which the plunger moves in such a direction as to increase the volume of a pressure chamber, and a feed stroke in which the plunger moves in such a direction as to reduce the volume of the pressure chamber. A flow regulating valve is provided in a fuel intake passage that communicates with the pressure chamber. The flow regulating valve is opened on the intake stroke, so that the fuel is drawn into the pressure chamber through the fuel intake passage, and the flow regulating valve is closed on the feed stroke, so that the fuel in the pressure chamber is pressurized to a given pressure and then delivered from the high-pressure fuel pump. Thus, the amount of the high-pressure fuel delivered from the high-pressure fuel pump can be adjusted by controlling the timing of opening and closing of the flow regulating valve.

In the fuel system of the direct injection type internal combustion engine as described above, the plunger is reciprocated by the cams that move along with the crankshaft. It is thus possible to appropriately regulate or control the amount of the fuel by detecting the position of the plunger that changes with the crank angle, and setting the timing of opening and closing of the flow regulating valve in accordance with the position of the plunger. When the internal combustion engine is in a relatively quiet operating condition, such as idling, however, the operating sound or noise produced upon opening and closing of the flow regulating valve becomes noticeable or annoying, and may degrade the quietness of the engine operation. In this connection, when the engine runs at idle after it has been warmed up, the fuel is relatively easily vaporized or formed into particles due to an increased coolant temperature, and the length of time from fuel injection to ignition is relatively long since the engine speed is low, while the pressure in each cylinder is relatively low. Therefore, even if the low-pressure chamber pressurized by the low-pressure fuel pump is injected into the combustion chambers, the low-pressure fuel can be sufficiently vaporized or formed into particles. Accordingly, during idling of the engine after its warm-up, the flow regulating valve is stopped at the open position, and the low-pressure fuel pressurized by the low-pressure fuel pump is passed as it is through the high-pressure fuel pump to be fed under pressure to the delivery pipe, so that the fuel injection valves inject the low-pressure fuel into the combustion chambers. In this manner, the operating sound or noise produced upon opening and closing of the flow regulating valve in the high-pressure fuel pump can be reduced or eliminated.

An example of fuel feed system of the direct injection type internal combustion engine as described above is disclosed in Japanese Patent No. 2874082.

In the fuel system of the known direct injection type internal combustion engine as described above, the plunger of the high-pressure fuel pump reciprocates in accordance with the rotation of the crankshaft. Therefore, even if the flow regulating valve is stopped at the open position and pressurizing and feeding of the fuel are stopped while the engine runs at idle after it has been warmed up, the plunger is driven all the time. Since the reciprocating motion of the plunger causes the fuel to be pushed periodically, pressure pulsation of the fuel takes place in the fuel passage, and causes variations or fluctuations in the fuel pressure in the fuel passage, and the variations in the fuel pressure are transmitted to the delivery pipe and the fuel injection valves. While a controller of the internal combustion engine controls the injection timing and injection amount of the fuel injected from the fuel injection valves, based on engine operating conditions, errors may arise in the amount of the fuel injected by the fuel injection valves if the pressure pulsation of the fuel is transmitted to the delivery pipe and the fuel injection valves. As a result, a desired or intended amount of fuel to be injected into the combustion chambers may not be injected from the fuel injection valves, and the air/fuel ratio may deviate from a target value.

SUMMARY OF THE INVENTION

In view of the problem as described above, this invention provides an internal combustion engine in which transmission of pressure pulsation of fuel that occurs due to driving of a high-pressure pump is effectively restricted or prevented, so that an appropriate amount of fuel can be supplied to the engine, thus preventing the air/fuel ratio from deviating from a target value.

According to one aspect of the invention, there is provided an internal combustion engine which includes: (a) a low-pressure fuel feed system that feeds a low-pressure fuel pressurized by a low-pressure pump to a low-pressure fuel volume chamber through a low-pressure fuel passage, (b) a low-pressure fuel injection device provided on the low-pressure fuel volume chamber for injecting the low-pressure fuel to an intake port, (c) a high-pressure fuel feed system that feeds a high-pressure fuel to a high-pressure fuel volume chamber through a high-pressure fuel passage, the high-pressure fuel feed system including a high-pressure pump that raises the pressure of the low-pressure fuel pressurized by the low-pressure pump to provide the high-pressure fuel, (d) a bypass passage that communicates the low-pressure fuel volume chamber with the high-pressure fuel feed system, and (e) a check valve provided in the bypass passage for preventing flow of the fuel from the high-pressure fuel feed system to the low-pressure fuel volume chamber.

In the internal combustion engine as described above, the bypass passage may communicate the low-pressure fuel volume chamber with the high-pressure fuel passage.

Also, the bypass passage may communicate the low-pressure fuel volume chamber with the high-pressure fuel volume chamber.

In the internal combustion engine as described above, a valve-opening pressure of the check valve at which the check valve opens to allow flow of the fuel from the low-pressure fuel volume chamber to the high-pressure fuel feed system may be set to be lower than a delivery pressure of the low-pressure fuel at which the low-pressure fuel is delivered by the low-pressure pump.

In the internal combustion engine as described above, a high-pressure fuel check valve may be provided for preventing reverse flow of the fuel from the high-pressure fuel feed system to the high-pressure pump, and a valve-opening pressure at which the high-pressure fuel check valve opens to allow flow of the fuel from the high-pressure pump to the high-pressure fuel passage may be set to be higher than the delivery pressure at which the low-pressure fuel is delivered by the low-pressure pump.

In the internal combustion engine as described above, a high-pressure fuel check valve may be provided for preventing reverse flow of the fuel from the high-pressure fuel passage to the high-pressure pump, and the high-pressure pump may include a plunger that moves in accordance with driving of the internal combustion engine so as to raise the pressure of the low-pressure fuel to provide the high-pressure fuel, and a flow regulating valve that is opened and closed so as to draw in the low-pressure fuel and deliver the high-pressure fuel. In this case, a valve-opening pressure at which the high-pressure fuel check valve opens to allow flow of the fuel from the high-pressure pump to the high-pressure fuel passage may be set to be higher than a maximum fuel pressure developed by operation of the plunger while the high-pressure pump does not perform high-pressure fuel pressure control.

In the internal combustion engine as described above, at least one pulsation reducing device that reduces pulsation of the fuel may be provided in the low-pressure fuel passage.

In the internal combustion engine as described above, the above-indicated at least one pulsation reducing device may be provided by setting the length of a fuel passage from an inlet of the high-pressure pump to the low-pressure fuel volume chamber, to a length with which fuel pulsation that occurs due to operation of the high-pressure pump is not transmitted to the low-pressure fuel volume chamber.

In the internal combustion engine as described above, the above-indicated at least one pulsation reducing device may include a restrictor provided in the low-pressure fuel passage for reducing an area of the fuel passage. The above-indicated at least one pulsation reducing device may further include a damper provided in the low-pressure fuel passage for damping pulsation of the fuel.

In the internal combustion engine as described above, the bypass passage may have a first branch passage and a second branch passage, and the check valve may be provided in the first branch passage while a relief valve may be provided in the second branch passage. In this embodiment, the relief valve is opened so as to return the fuel to the low-pressure fuel volume chamber when the pressure of the high-pressure fuel in the high-pressure fuel feed system exceeds a predetermined pressure level.

In the internal combustion engine as described above, the relief valve may consist of an electromagnetic valve whose opening can be electrically controlled.

The fuel feed system of the internal combustion engine according to the invention has the low-pressure fuel feed system that feeds the low-pressure fuel pressurized by the low-pressure pump to the low-pressure fuel volume chamber through the low-pressure fuel passage, and the high-pressure fuel feed system that feeds the high-pressure fuel delivered from the high-pressure pump that pressurizes the low-pressure fuel delivered from the low-pressure pump, to the high-pressure fuel volume chamber, through the high-pressure fuel passage. The low-pressure fuel volume chamber and the high-pressure fuel passage or high-pressure fuel volume chamber included in the high-pressure fuel feed system communicate with each other via the bypass passage, and the check valve is provided in the bypass passage for preventing flow of the fuel from the high-pressure fuel passage or high-pressure fuel volume chamber to the low-pressure fuel volume chamber. Since the low-pressure fuel volume chamber having a relatively large volume communicates with the high-pressure fuel passage or high-pressure fuel volume chamber via the bypass passage, transmission of fuel pressure pulsation caused by the high-pressure pump is effectively restricted or prevented by the low-pressure fuel passage and the low-pressure fuel volume chamber, and an appropriate amount of fuel can be supplied to the fuel injection device, so that the air/fuel ratio can be prevented from deviating from a target value.

BRIEF DESCRIPTION OF THE DRAWINGS

The features, advantages, and technical and industrial significance of this invention will be better understood by reading the following detailed description of preferred embodiments of the invention, when considered in connection with the accompanying drawings, in which.

DETAILED DESCRIPTION OF THE PREFERRED EMBODIMENTS

In the following description and the accompanying drawings, the present invention will be described in more detail with reference to exemplary embodiments. It is to be understood that the invention is not limited to details of these embodiments.

Figure 1:
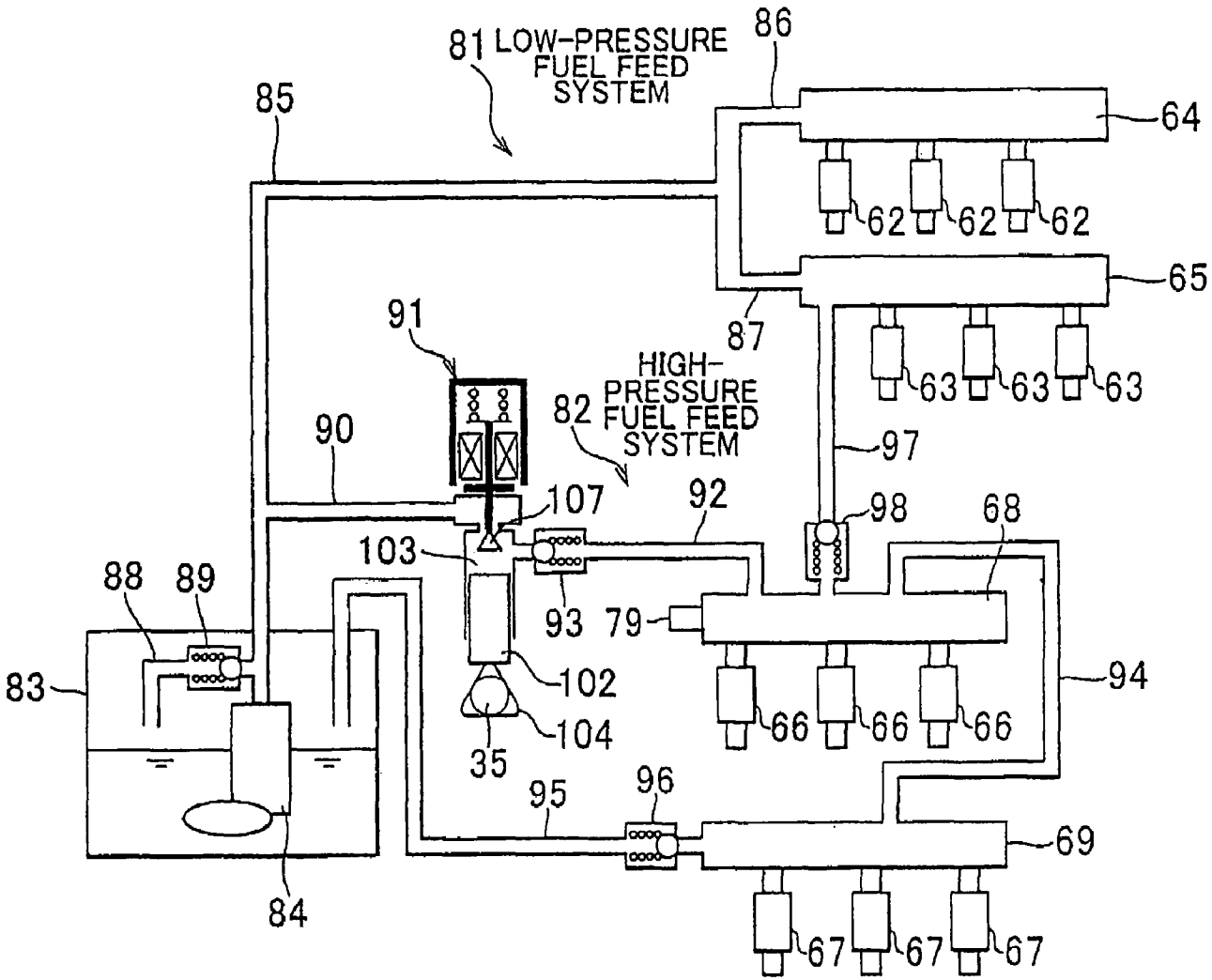
FIG. 1 is a schematic view showing a fuel system of an internal combustion engine according to a first embodiment of the invention.
Figure 2:
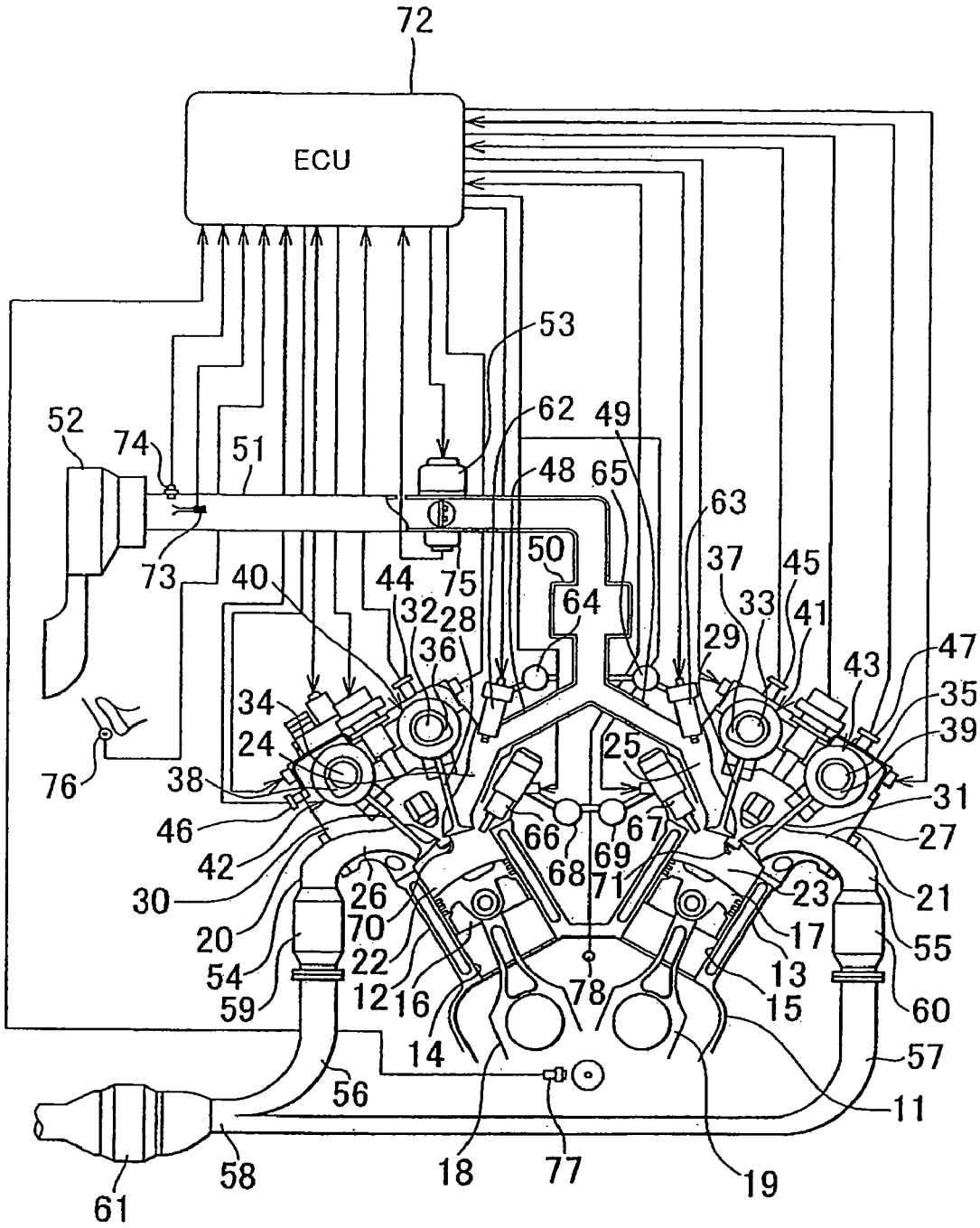
FIG. 2 is a vertical cross-sectional view showing a principal part of the internal combustion engine of the first embodiment.
Figure 3:
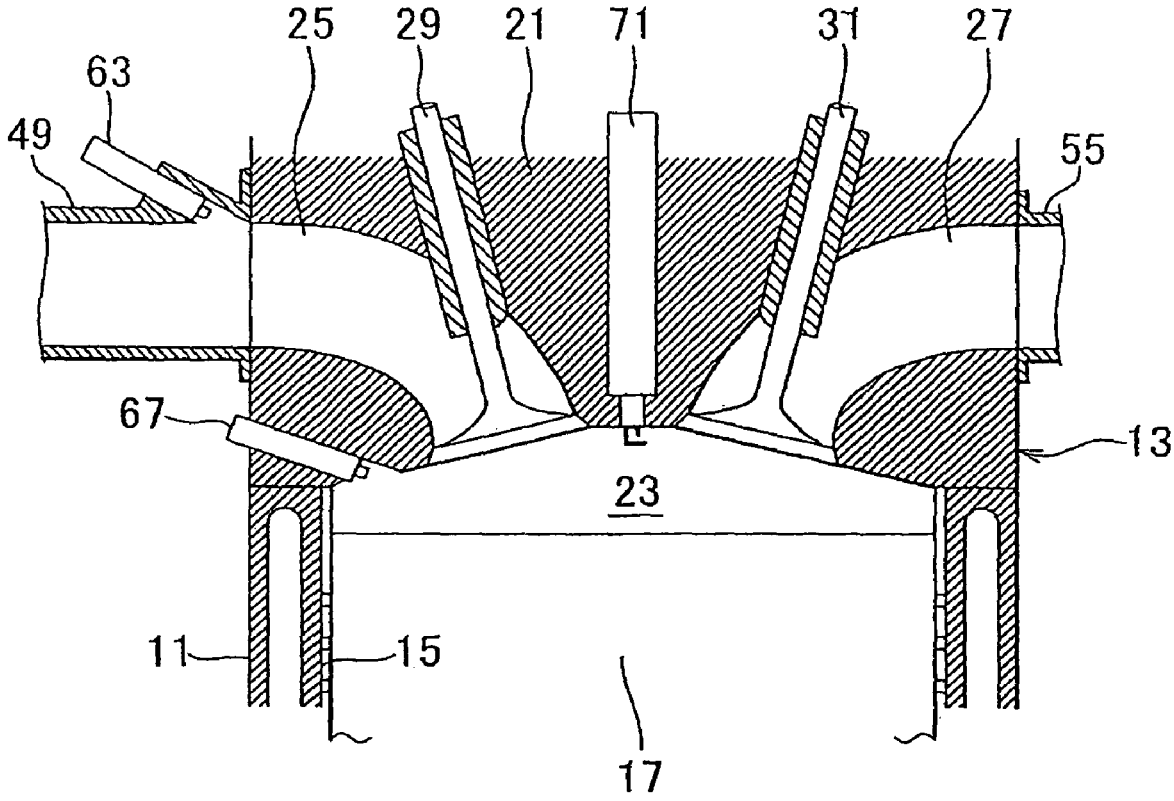
FIG. 3 is a cross-sectional view showing a combustion chamber of the internal combustion engine of the first embodiment.
Figure 4:
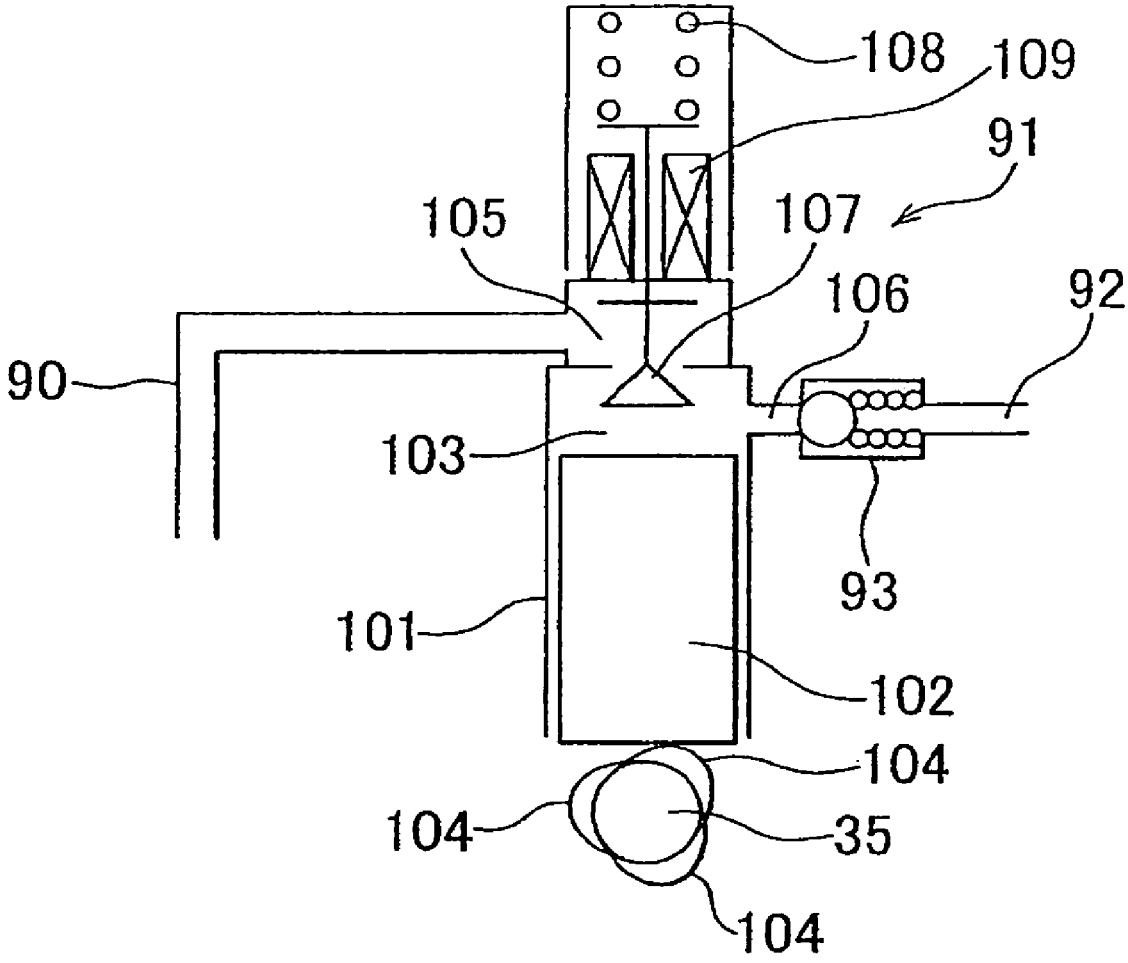
FIG. 4 is a schematic view showing the construction of a high-pressure pump used in a high-pressure fuel feed system of the internal combustion engine of the first embodiment.

FIG. 1 is a schematic view showing a fuel system of an internal combustion engine according to a first embodiment of the invention, and FIG. 2 is a vertical cross-sectional view showing a principal part of the internal combustion engine of the first embodiment. FIG. 3 is a cross-sectional view showing a combustion chamber formed in the internal combustion engine of the first embodiment, and FIG. 4 is a schematic view showing the construction of a high-pressure pump used in a high-pressure fuel feed system of the internal combustion engine of the first embodiment.

In the first embodiment, the internal combustion engine is in the form of a V-type six-cylinder gasoline engine having port injection type fuel injection devices and direct or in-cylinder injection type fuel injection devices. In the V-type six-cylinder engine as shown in FIG. 2 and FIG. 3, a cylinder block 11 has left and right banks 12, 13 located in its upper portion such that each of the banks 12, 13 is inclined a certain angle relative to the vertical direction of the engine, and three cylinder bores 14, 15 are formed in each of the banks 12, 13, while a piston 16, 17 is received in each of the cylinder bores 14, 15 such that the piston 16, 17 can move up and down in the corresponding cylinder bore 14, 15. A crankshaft (not shown) is rotatably supported in a lower portion of the cylinder block 11, and the pistons 16, 17 are respectively connected to the crankshaft via connecting rods 18, 19.

On the other hand, cylinder heads 20, 21 are fastened onto the top faces of the respective banks 12, 13 of the cylinder block 11, and the cylinder block 11, each of the pistons 16, 17 and the corresponding cylinder head 20, 21 cooperate to form a combustion chamber 22, 23 in each of the cylinders. Intake ports 24, 25 and exhaust ports 26, 27 are formed above the combustion chambers 22, 23, namely, at the lower faces of the cylinder heads 20, 21, such that the intake ports 24, 25 are opposed to the exhaust ports 26, 27, and lower end portions of intake valves 28, 29 and exhaust valves 30, 31 are located in the intake ports 24, 25 and exhaust ports 26, 27, respectively. The intake valves 28, 29 and the exhaust valves 30, 31 are axially movably supported by the cylinder heads 20, 21, and are biased in such directions as to close the intake ports 24, 25 and the exhaust ports 26, 27, respectively. Intake camshafts 32, 33 and exhaust camshafts 34, 35 are rotatably supported by the cylinder heads 20, 21, and intake cams 36, 37 and exhaust cams 38, 39 formed on the intake camshafts 32, 33 and exhaust camshafts 34, 35 are in contact with the upper end portions of the intake valves 28, 29 and exhaust valves 30, 31, respectively, via roller rocker arms (not shown).

With the above arrangement, when the intake camshafts 32, 33 and exhaust camshafts 34, 35 rotate in synchronization with the engine, the intake cams 36, 37 and exhaust cams 38, 39 actuate the corresponding roller rocker arms so as to move the intake valves 28, 29 and exhaust valves 30, 31 in the axial directions thereof in certain timing, thereby to open and close the intake ports 24, 25 and exhaust ports 26, 27. When the intake valves 28, 29 or the exhaust valves 30, 31 are moved down to open the intake ports 24, 25 or the exhaust ports, 26, 27, the intake ports 24, 25 and the combustion chambers 22, 23, or the combustion chambers 22, 23 and the exhaust ports 26, 27, can be brought into communication with each other.

The engine further includes a valve actuating system that consists of variable intake-valve timing mechanisms (VVT: Variable Valve Timing-intelligent) 40, 41 and variable exhaust-valve timing mechanisms 42, 43, which control the intake valves 28, 29 and the exhaust valves 30, 31, respectively, to the optimum open/close timing in accordance with engine operating conditions. For example, VVT controllers are mounted on axial end portions of the intake camshafts 32, 33 and exhaust camshafts 34, 35 to provide the variable intake-valve timing mechanisms 40, 41 and the variable exhaust-valve timing mechanisms 42, 43, respectively. The VVT controller causes a hydraulic pump (or an electric motor) to change the phase of each of the camshafts 32, 33, 34, 35 relative to a corresponding cam sprocket, so as to advance or retard the open/close time of the corresponding ones of the intake valves 28, 29 and exhaust valves 30, 31. In this case, each of the variable valve timing mechanisms 40, 41, 42 43 advances or retards the open/close time of the corresponding intake valves 28, 29 or exhaust valves 30, 31 while keeping the operation angle (or open period) of the intake valves 28, 29 or exhaust valves 30, 31 constant. The intake camshafts 32, 33 and exhaust camshafts 34, 35 are respectively provided with cam position sensors 44, 45, 46, 47 for detecting the phases of rotation thereof.

A surge tank 50 is connected to the intake ports 24, 25 of each of the cylinder heads 20, 21 via an intake manifold 48, 49, and an intake pipe 51 is joined to the surge tank 50. An air cleaner 52 is mounted at an air inlet of the intake pipe 51. An electronic throttle device 53 having a throttle valve is located in a portion of the intake pipe 51 downstream of the air cleaner 52. On the other hand, exhaust pipes 56, 57 are connected to the exhaust ports 26, 27 via exhaust manifolds 54, 55, respectively, and the exhaust pipes 56, 57 are joined together into an exhaust collection pipe 58. Three-way catalysts 59, 60 are mounted in the exhaust pipes 56, 57, respectively, and a NOx storage-reduction type catalyst 61 is mounted in the exhaust collection pipe 58.

First injectors (low-pressure fuel injection devices) 62, 63 for injecting fuel (gasoline) into the respective intake ports 24, 25 are mounted in each of the cylinder heads 20, 21, and the first injectors 62, 63 are mounted to first delivery pipes 64, 65, respectively. Also, second injectors (high-pressure fuel injection devices) 66, 67 for injecting fuel (gasoline) directly into the respective combustion chambers 22, 23 are mounted in each of the cylinder heads 20, 21, and the second injectors 66, 67 are mounted to second delivery pipes 68, 69, respectively. With this arrangement, the first injectors 62, 63 can inject low-pressure fuel stored in the first delivery pipes 64, 65 into the corresponding intake ports 24, 25, and the second injectors 66, 67 can inject high-pressure fuel stored in the second delivery pipes 68, 69 into the corresponding combustion chambers 22, 23. Also, ignition plugs 70, 71 for firing or igniting fuel-air mixtures are mounted in the cylinder heads 20, 21 such that each of the ignition plugs 70, 71 is located at the top of the corresponding combustion chamber 22, 23.

An electronic control unit (ECU) 72 is installed on the vehicle. The ECU 72 is able to control the fuel injection timing of each of the injectors 62, 63, 66, 67, the ignition timing of the ignition plugs 70, 71, and so forth, and determines the fuel injection amount, the fuel injection timing, the ignition timing, and so forth, based on engine operating, conditions including, for example, the detected intake air amount, intake air temperature, throttle opening, accelerator pedal position, engine speed and the coolant temperature.

More specifically, an air flow meter 73 and an intake air temperature sensor 74 mounted in an upstream portion of the intake pipe 51 measure the intake air amount and the intake air temperature, respectively, and output the measured intake air amount and intake air temperature to the ECU 72. Also, a throttle position sensor 75 provided in the electronic throttle device 53 and an accelerator position sensor 76 provided at the accelerator pedal detect the current throttle opening and the current accelerator pedal position, respectively, and output the detected throttle opening and accelerator pedal position to the ECU 72. Furthermore, a crank angle sensor 77 provided at the crankshaft detects the crank angle, and outputs the detected crank angle to the ECU 72, and the ECU 72 calculates the engine speed based on the crank angle. In addition, a water temperature sensor 78 provided in the cylinder block 11 detects the engine coolant temperature, and outputs the detected coolant temperature to the ECU 72.

The ECU 72 is also able to control the variable intake-valve timing mechanisms 40, 41 and the variable exhaust-valve timing mechanisms 42, 43 based on the engine operating conditions. More specifically, when the engine operates at low temperatures or at a light load, or when the engine starts or idles, the ECU 72 controls the variable valve timing mechanisms 40, 41, 42, 43 to eliminate an overlap between the open period of the exhaust valves 30, 31 and the open period of the intake valves 28, 29, so as to reduce the amount of exhaust gas that blows back into the intake ports 24, 25 or the combustion chambers 22, 23, and thus achieve stable combustion and improved fuel economy. When the engine operates at a middle load, the ECU 72 controls the variable valve timing mechanisms 40, 41, 42, 43 to increase the above-mentioned overlap, so as to increase the internal EGR rate for improved exhaust gas purification efficiency and reduce pumping losses for improved fuel economy. When the engine runs at a low to middle speed with a high load, the ECU 72 controls the variable intake-valve timing mechanisms 40, 41 to advance the time at which the intake valves 28, 29 are closed, so as to reduce the amount of intake air that blows back into the intake ports 24, 25 for improved volumetric efficiency. When the engine runs at a high speed with a high load, the ECU 72 controls the variable intake-valve timing mechanisms 40, 41 to retard the time at which the intake valves 28, 29 are closed in accordance with the engine speed, so as to provide open/close timing that matches the inertial force of the intake air and thus improve the volumetric efficiency.

The V-type six-cylinder gasoline engine of the first embodiment constructed as described above is provided with a low-pressure fuel feed system 81 that transfers low-pressure fuel, and a high-pressure fuel feed system 82 that branches off from the low-pressure fuel feed system 81 and transfers high-pressure fuel. The first injectors 62, 63 serving as low-pressure fuel injection devices for injecting fuel into the intake ports 24, 25 are joined to the low-pressure fuel feed system 81, and the second injectors 66, 67 for injecting fuel directly into the combustion chambers 22, 23 are joined to the high-pressure fuel feed system 82.

In the low-pressure fuel feed system 81, a feed pump (low-pressure pump) 84 is provided in a fuel tank 83 in which fuel is stored, and the feed pump 84 is connected to two first delivery pipes 64, 65 arranged in parallel with each other, via a low-pressure fuel feed pipe 85 and two low-pressure fuel branch pipes 86, 87 into which the low-pressure fuel feed pipe 85 is split. The feed pump 84 is an electrically operated, low-pressure fuel pump that raises the pressure of the fuel in the fuel tank 83 to a specified pressure level (low pressure) and delivers the fuel to the low-pressure fuel feed pipe 85. Three first injectors 62, 63 are mounted to each of the first delivery pipes 64, 65. Also, a low-pressure fuel return pipe 88 branches off from a proximal end portion (close to the feed pump 84) of the low-pressure fuel feed pipe 85, and a regulator 89 is mounted in the low-pressure fuel return pipe 88. With this arrangement, when the pressure of the fuel in the low-pressure fuel feed system 81 becomes higher than a specified pressure, a part of the low-pressure fuel delivered from the feed pump 84 is returned to the fuel tank 83 through the low-pressure fuel return pipe 88 and the regulator 89, so that the pressure of the fuel in the low-pressure fuel feed system 81, namely, in the first delivery pipes 64, 65, can be kept at the specified low pressure.

In the high-pressure fuel feed system 82, a branch pipe 90 branches off from a midstream portion of the low-pressure fuel feed pipe 85 of the low-pressure fuel feed system 81, and a high-pressure pump 91 is joined to a distal end portion of the branch pipe 90. The high-pressure pump 91 is connected to one of the second delivery pipes 68 via a high-pressure fuel feed pipe 92, and a high-pressure fuel check valve 93 is mounted in the high-pressure fuel feed pipe 92. A distal end portion of the high-pressure fuel feed pipe 92 is also connected to the other second delivery pipe 69 via a high-pressure fuel communicating pipe 94.

The high-pressure pump 91 is a flow regulator type high-pressure fuel pump that is driven by the rotating exhaust camshaft 35 of the engine, and is operable to raise the pressure of the low-pressure fuel of the low-pressure fuel feed pipe 85 in the low-pressure fuel feed system 81 to a specified pressure level to provide high-pressure fuel. The high-pressure pump 91 feeds the high-pressure fuel to the second delivery pipe 68 through the high-pressure fuel feed pipe 92, and further feeds the high-pressure fuel to the second delivery pipe 69 through the high-pressure fuel communicating pipe 94. The high-pressure fuel check valve 93 serves to prevent the high-pressure fuel fed from the high-pressure pump 91 to the second delivery pipes 68, 69 from flowing back into the low-pressure fuel feed system 81.

In the following, the high-pressure pump 91 provided in the high-pressure fuel feed system 82 will be described in more detail with reference to FIG. 4. In the high-pressure pump 91, a plunger 102 is freely movably supported in a casing 101 having a cylindrical shape, and the casing 101 and the plunger 102 cooperate to form a pressure chamber 103 in which the fuel is pressurized. The plunger 102 is biased by a spring (not shown) in such a direction (downward in FIG. 4) as to expand the pressure chamber 103. Three drive cams 104 are formed on a longitudinally end portion of the exhaust camshaft 35 on the side of the second bank 13, and a lower end portion of the plunger 102 is in contact with any one of the drive cams 104 all the time. As the exhaust camshaft 35 rotates, the drive cams 104 move the plunger 102 up and down, thereby to increase and reduce the volume of the pressure chamber 103.

The high-pressure pump 91 has an inlet 105 and an outlet 106 formed in the upper portion of the casing 101. The inlet 105 communicates with the branch pipe 90 on the side of the low-pressure fuel feed system 81, and the outlet 106 communicates with the pressure chamber 103 and the high-pressure fuel feed pipe 92 on the side of the high-pressure fuel feed system 82. In this case, the outlet 106 is connected to the high-pressure fuel feed pipe 92 via the high-pressure fuel check valve 93. In the upper portion of the casing 101, an electromagnetic spill valve 107 as a flow regulating valve for opening and closing the inlet 105 is supported such that the valve 107 is movable in -the vertical direction. The electromagnetic spill valve 107 is biased by a bias spring 108 in such a direction as to open the inlet 105. When current is applied to a solenoid 109 provided in the upper portion of the casing 101, the electromagnetic spill valve 107 is moved up so as to close the inlet 105.

With the above arrangement, when the plunger 102 driven by the drive cams 104 moves down during rotation of the exhaust camshaft 35 while the inlet 56 is placed in the open state by the electromagnetic spill valve 107, the low-pressure fuel in the branch pipe 90 of the low-pressure fuel feed system 81 is drawn into the pressure chamber 103 through the inlet 105. When the plunger 102 driven by the drive cams 104 moves up as the exhaust camshaft 35 keeps rotating, the solenoid 109 is energized so as to move up the electromagnetic spill valve 107 and cause the spill valve 107 to close the inlet 105, whereby the pressure of the low-pressure fuel in the pressure chamber 103 is raised to a certain pressure level. Thereafter, the resulting high-pressure fuel can be delivered from the outlet 106 into the high-pressure fuel feed pipe 92 of the high-pressure fuel feed system 82, through the high-pressure check valve 93 that is opened when receiving the high-pressure fuel.

In this case, the ECU 72 controls the timing of current application to the solenoid 109 in accordance with the high-pressure fuel pressure detected by a fuel pressure sensor 79 provided in the second delivery pipes 68, 69, so as to control the time at which the electromagnetic spill valve 107 closes the inlet 105, and thus adjust the amount of the fuel delivered to the high-pressure fuel feed pipe 92. The electromagnetic spill valve 107 is a normally open type spill valve that is normally held in an open state by the bias spring 108. While no current is applied to the solenoid 109, the electromagnetic spill valve 107 is placed in the open state in which the inlet 105 is open, such that the low-pressure fuel in the branch pipe 90 can flow into the high-pressure fuel feed pipe 92, through the inlet 105, pressure chamber 103 and the outlet 106. Thus, even in the event of a failure of the solenoid 109, the inlet 105 is held in the open state, so that failed supply of the fuel and/or damage or breakage of the fuel system can be minimized.

Referring back to FIG. 1, the second delivery pipe 69 is connected to the fuel tank 83 via a high-pressure fuel return pipe 95, and a relief valve 96 is mounted in the high-pressure fuel return pipe 95. Therefore, the pressure of the fuel fed from the high-pressure pump 91 to the second delivery pipes 68, 69 can be kept constant by the relief valve 96, and an excess of the fuel can be returned to the fuel tank 13 via the high-pressure fuel return pipe 95 when the pressure of the fuel becomes higher than a specified pressure level. In this case, since the pressure of the fuel in the second delivery pipes 68, 69 is applied to the relief valve 96 as a valve-opening pressure, the valve-opening pressure of the relief valve 96 needs to be set in accordance with the fuel injection pressure required for the second injectors 66, 67 to inject the fuel.

In the first embodiment, the low-pressure fuel feed pipe 85 and the low-pressure fuel branch pipes 86, 87 constitute the low-pressure fuel passage of the invention, and the first delivery pipes 64, 65 constitute the low-pressure fuel volume chamber of the invention, while the low-pressure fuel feed pipe 85, low-pressure fuel branch pipes 86, 87 and the first delivery pipes 64, 65 constitute the low-pressure fuel feed system 81. Meanwhile, the high-pressure fuel feed pipe 92 and the high-pressure fuel communicating pipe 94 constitute the high-pressure fuel passage of the invention, and the second delivery pipes 68, 69 constitute the high-pressure fuel volume chamber of the invention, while the high-pressure fuel feed pipe 92, high-pressure fuel communicating pipe 94 and the second delivery pipes 68, 69 constitute the high-pressure fuel feed system 82 of the invention.

The V-type six-cylinder engine of the first embodiment includes the low-pressure fuel feed system 81 and the port injection type first injectors 62, 63, and further includes the high-pressure fuel feed system 82 and the direct injection type second injectors 66, 67. Therefore, the engine selectively uses the fuel feed system and the injectors, depending on the engine operating conditions. Generally, the high-pressure fuel feed system 82 and direct injection type second injectors 66, 67 are used in a low-load operating region of the engine, and the low-pressure fuel feed system 81 and port injection type first injectors 62, 63, and the high-pressure fuel feed system 82 and direct injection type second injectors 66, 67 are both used in middle- to high-load operating regions of the engine.

In the high-pressure pump 91 of the high-pressure fuel feed system 82, the plunger 102 is reciprocated (i.e., moved up and down) by the drive cams 104 of the exhaust camshaft 35. Thus, the ECU 72 detects the position of the plunger 102 based on a detection signal of the crank angle sensor 77 (or the cam position sensor 47), and sets the open/close timing of the electromagnetic spill valve 107 in accordance with the position of the plunger 102, so as to appropriately regulate the amount of the fuel delivered from the high-pressure pump 91. However, when the engine is in a relatively quiet operating condition, such as idling, the operating sound or noise produced upon opening and closing of the electromagnetic spill valve 107 becomes noticeable, and degrades the quietness of the engine operation.

In this connection, when the engine runs at idle after it has been warmed up, the fuel is relatively easily vaporized and formed into particles since the coolant temperature is high, and the period of time it takes from fuel injection to ignition is relatively long and the pressure in each cylinder is relatively low since the engine speed is low. Therefore, even if low-pressure fuel pressurized by the feed pump 84 is injected into the combustion chambers 22, 23, the low-pressure fuel can be sufficiently vaporized and formed into particles. Thus, in the first embodiment, the electromagnetic spill valve 107 is stopped at the valve-open position during idling of the engine, and the low-pressure fuel pressurized by the feed pump 84 is fed under pressure to the second delivery pipes 68, 69 while bypassing the high-pressure pump 91, so that the second injectors 66, 67 inject the low-pressure fuel into the combustion chambers 22, 23. In this manner, the operating sound caused by opening and closing of the electromagnetic spill valve 107 in the high-pressure pump 91 is reduced.

In the high-pressure pump 91 in which the plunger 102 reciprocates in accordance with the rotation of the exhaust camshaft 35, the plunger 102 is driven all the time even when the electromagnetic spill valve 107 is stopped at the valve-open position and stops pressurizing and feeding the fuel during idling of the engine after its warm-up. Therefore, the fuel is pushed periodically due to the reciprocating motion of the plunger 102, and pressure pulsation of the fuel takes place in the fuel feed pipes 85, 92 and other portions of the fuel system, resulting in fluctuations or variations in the pressure of the fuel. The fluctuations in the fuel pressure are then transmitted to each of the delivery pipes 64, 65, 68 69 and each of the injectors 62, 63, 66, 67. As a result, errors may arise in the amounts of fuel injected by the injectors 62, 63, 66, 67, and each injector may not be able to inject an intended amount of fuel to be injected into the corresponding combustion chamber 22, 23, resulting in poor control of the air/fuel ratio.

In the first embodiment, therefore, a bypass pipe 97 is provided for connecting the first delivery pipe 65 of the low-pressure fuel feed system 81 with the second delivery pipe 68 of the high-pressure fuel feed system 82, and a check valve 98 for preventing flow of fuel from the second delivery pipe 68 to the first delivery pipe 65 is mounted in the bypass pipe 97, as shown in FIG. 1. In this case, the valve-opening pressure of the check valve 98, i.e., the pressure at which the check valve 98 opens to allow flow of the fuel from the first delivery pipe 65 to the second delivery pipe 68, is set to be lower than the delivery pressure of the low-pressure fuel when delivered by the feed pump 84. In another example, the bypass pipe 97 may be provided between the first delivery pipe 65 and the high-pressure fuel feed pipe 92 of the high-pressure feed system 82 for fluid communication therebetween. In this case, too, the check valve 98 for preventing flow of fuel from the high-pressure fuel feed pipe 92 to the first delivery pipe 65 is mounted in the bypass pipe 97.

With the above arrangement, when the electromagnetic spill valve 107 is stopped at the valve-open position and stops pressurizing and feeding the fuel while the feed pump 84 is being driven, the low-pressure fuel delivered from the feed pump 84 is fed to the first delivery pipes 64, 65 through the low-pressure fuel feed pipe 85 and the low-pressure fuel branch pipes 86, 87, and is further fed to the second delivery pipes 68, 69 through the bypass pipe 97 in which the check valve 98 is opened, so that each of the second injectors 66, 67 can inject the low-pressure fuel into the corresponding combustion chamber 22, 23.

On the other hand, it is desirable that the valve-opening pressure of the high-pressure fuel check valve 93 provided in the high-pressure fuel feed pipe 92, i.e., the pressure at which the check valve 93 opens to allow flow of the fuel from the high-pressure pump 91 to the high-pressure fuel feed pipe 92, is set to be higher than the delivery pressure of the low-pressure fuel when delivered by the feed pump 84. Since the low-pressure fuel delivered from the feed pump 84 is fed to the second delivery pipes 68, 69 through the low-pressure fuel feed pipe 85, low-pressure fuel branch pipe 87, first delivery pipe 65 and the bypass pipe 97, the fuel pressure in the high-pressure fuel feed pipe 92 and the fuel pressure in the second delivery pipes 68, 69 become substantially equal to each other. Therefore, the valve-opening pressure at which the high-pressure fuel check valve 93 opens to allow flow of the fuel from the high-pressure pump 91 to the high-pressure fuel feed pipe 92 may be set to be higher than the maximum fuel pressure (i.e., the highest level of the pulsating fuel pressure) developed by the operation of the plunger 102 when the high-pressure pump 91 does not perform high-pressure fuel pressure control (i.e., during non-energization of the high-pressure pump 91).

In the first embodiment, at least one pulsation reducing device for reducing pulsation of the fuel is provided in the low-pressure fuel feed pipe 85 and the low-pressure fuel branch pipes 86, 87. More specifically, the pulsation reducing device is provided by setting the length of a fuel passage that extends from the inlet 105 of the high-pressure pump 91 to the first delivery pipes 64, 65, to a length with which the fuel pulsation that occurs due to the operation of the high-pressure pump 91 is not transmitted to the first delivery pipes 64, 65. In this case, the length of the fuel passage from the inlet 105 of the high-pressure pump 91 to the first delivery pipes 64, 65 is the sum of the entire length of the branch passage 90, the length from a joint at which the branch passage 90 is joined to the low-pressure fuel feed pipe 85 to a joint at which the low-pressure fuel feed pipe 85 is joined to the low-pressure fuel branch pipes 86, 87, and the entire length of the low-pressure fuel branch pipes 86, 87.

In the following, the operation of the V-type six-cylinder engine of the first embodiment will be explained. As shown in FIG. 1 and FIG. 2, the ECU 72 calculates the amount of fuel to be supplied to the engine, using a stored map, based on the detected engine speed and the accelerator pedal position (throttle opening). The ECU 72 also determines based on the engine load whether the fuel is only injected into the combustion chambers 22, 23, or the fuel is injected into both the intake ports 24, 25 and the combustion chambers 22, 23. When the engine is in a low-load operating region, the high-pressure fuel feed system 82 and the second injectors 66, 67 are used for injecting the fuel into the combustion chambers 22, 23. When the engine is in a middle-load operating region, the high-pressure fuel feed system 82 and the second injectors 66, 67 are used for injecting the fuel into the combustion chambers 22, 23, and the low-pressure fuel feed system 81 and the first injectors 62, 63 are also used for injecting the fuel into the intake ports 24, 25. As the engine load increases, and the engine is brought into a high-load operating region, the amount of fuel injected into the intake ports 24, 25 is increased.

More specifically described, when the engine is started, the feed pump 84 is driven to pump up the fuel in the fuel tank 83 and raise the pressure of the fuel to a certain pressure level, and delivers the resulting low-pressure fuel to the low-pressure fuel feed pipe 85. In the low-pressure fuel feed system 81, the low-pressure fuel is fed from the low-pressure fuel feed pipe 85 to the first delivery pipes 64, 65 through the low-pressure fuel branch pipes 86, 87, such that the pressure of the fuel in the first delivery pipes 64, 65 is kept at a specified low pressure by means of the regulator 89.

In the high-pressure fuel feed system 82, on the other hand, the low-pressure fuel delivered from the feed pump 84 to the low-pressure fuel feed pipe 85 is fed to the high-pressure pump 91 through the branch pipe 90, and the high-pressure pump 91 raises the pressure of the low-pressure fuel to a certain pressure level to provide high-pressure fuel. The pressure of the high-pressure fuel is applied to the high-pressure fuel check valve 93 to open the check valve 93, and the high-pressure fuel is fed to the second delivery pipe 68 through the high-pressure fuel feed pipe 92, and is further fed to the second delivery pipe 69 through the high-pressure fuel communicating pipe 94. Then, the pressure of the fuel in the second delivery pipes 68, 69 is kept at a specified pressure level by means of the relief valve 96.

In this condition, if the ECU 72 determines that the fuel is to be injected into the cylinders (combustion chambers), i.e., direct fuel injection is to be performed, based on the engine operating conditions, the ECU 72 generates output signals indicative of the injection timing and injection amount (valve-open period) to the second injectors 66, 67 and performs in-cylinder or direct fuel injection so as to supply the required amount of fuel to the engine. More specifically, each of the second injectors 66, 67 injects fuel into the corresponding combustion chamber 22, 23 during the intake stroke or compression stroke of each cylinder. The fuel thus injected is mixed with air drawn from the corresponding intake port 24, 25 into the combustion chamber 22, 23, to form a fuel-air mixture in the combustion chamber 22, 23. The fuel-air mixture is compressed by the piston 16, 17, and is then fired by the ignition plug 70, 71, so that the mixture explodes and expands, thereby to apply force (torque) to the crankshaft via the piston 16, 17 for rotation of the crankshaft.

If the ECU 72 determines that the fuel is to be injected into the intake ports and also injected into the cylinders, based on the engine operating conditions, the ECU 72 generates output signals indicative of the injection timing and injection amount (valve-open period) to the first injectors 62, 63 and the second injectors 66, 67, and performs fuel injection into the intake ports (port injection) and fuel injection into the cylinders (direct injection) so as to supply the required amount of fuel to the engine. More specifically, each of the first injectors 62, 63 injects fuel into the corresponding intake port 24, 25 during the initial period of the intake stroke of each cylinder. The fuel thus injected is mixed with air flowing through the intake port 24, 25 to provide a fuel-air mixture, which is then introduced into the corresponding combustion chamber 22, 23 when the intake valve 28, 29 is opened. Each of the second injectors 66, 67 injects fuel into the corresponding combustion chamber 22, 23 during the intake stroke or compression stroke of each cylinder. The fuel thus injected is mixed with the fuel-air mixture drawn from the intake port 24, 25 in the combustion chamber 22, 23. The resulting fuel-air mixture is compressed by the piston 16, 17, and is then fixed by the ignition plug 70, 71, so that the mixture explodes and expands, thereby to apply force (torque) to the crankshaft via the piston 16, 17 for rotation of the crankshaft.

In the V-type six-cylinder engine of the first embodiment, the electromagnetic spill valve 107 of the high-pressure pump 91 is stopped at the valve-open position during idling of the engine after its warm-up, so that the low-pressure fuel pressurized by the feed pump 84 is fed under pressure to the second delivery pipes 68, 69 while bypassing the high-pressure pump 91, and the second injectors 66, 67 inject the low-pressure fuel into the combustion chambers 22, 23.

More specifically, when the engine runs at idle after it has been warmed up, the ECU 72 stops energizing the high-pressure pump 91 to bring the pump 91 into a non-energized condition, so as to stop the electromagnetic spill valve 107 at the valve-open position. Then, the second injectors 66, 67 inject fuel into the combustion chambers 22, 23, and the fuel pressure in the second delivery pipes 68, 69 is reduced. On the other hand, the low-pressure fuel pressurized by the feed pump 84 is fed from the low-pressure fuel feed pipe 85 to the first delivery pipes 64, 65 through the low-pressure fuel branch pipes 86, 87, and is further fed from the first delivery pipe 65 to the check valve 98 through the bypass pipe 97. When the fuel pressure in the second delivery pipes 68, 69 is reduced to be lower than that of the low-pressure fuel delivered from the feed pump 84 due to the fuel injection of the second injectors 66, 67, the check valve 98 opens, and the low-pressure fuel in the first delivery pipe 65 is fed to the second delivery pipes 68, 69 through the bypass pipe 97 and the check valve 98. Namely, the low-pressure fuel pressurized by the feed pump 84 is fed under pressure to the second delivery pipes 68, 69 while bypassing the high-pressure pump 91, so that the second injectors 66, 67 can inject the low-pressure fuel into the combustion chambers 22, 23.

As described above, the valve-opening pressure of the high-pressure fuel check valve 93 is set to be higher than the delivery pressure of the low-pressure fuel, i.e., the pressure at which the low-pressure fuel is delivered by the feed pump 84, and is desirably set to be higher than the fuel pulsating pressure developed by the operation of the plunger 102 during non-energization of the high-pressure pump 91, so that the high-pressure fuel check valve 93 does not open due to the pulsating pressure of the fuel resulting from the reciprocating motion of the plunger 102. Therefore, when the high-pressure pump 91 is not energized, the pressure pulsation of the fuel due to the reciprocating motion of the plunger 102 is prevented from being transmitted to the second delivery pipes 68, 69 through the high-pressure fuel feed pipe 92. In this connection, it is desirable that the upper limit of the valve-opening pressure of the high-pressure fuel check valve 93 is set to the minimum value within a range that is higher than the pulsating pressure, in view of variations in the pulsating pressure. This is because an excessively high valve-opening pressure may become an impediment to the feeding of the fuel pressurized by the high-pressure pump 91, resulting in reduced feeding efficiency of the high-pressure pump 91. By setting the upper limit of the valve-opening pressure in the manner as described above, the reduction of the feeding efficiency of the high-pressure pump 91 is prevented.

When the engine runs at idle after its warm-up, current application to the high-pressure pump 91 is stopped, and the electromagnetic spill valve 107 is stopped in the valve-open condition, so that the low-pressure fuel pressurized by the low-pressure pump 84 bypasses the high-pressure pump 91, and is fed to the second delivery pipes 68, 69 through the low-pressure fuel feed system 81 and the bypass pipe 97. Therefore, the operating sound or noise produced upon opening and closing of the electromagnetic spill valve 107 is reduced in a relatively quiet operating region, such as idling, of the engine.

When the engine runs at idle after its warm-up, the low-pressure fuel pressurized by the low-pressure pump 84 is fed to the second delivery pipes 68, 69 through the low-pressure fuel feed system 81 and the bypass pipe 97. The length of the fuel passage that extends from the inlet 105 of the high-pressure pump 91 to each of the first delivery pipes 64, 65 is set to the length with which the fuel pulsation caused by the operation of the high-pressure pump 91 is not transmitted to the first delivery pipes 64, 65. Therefore, the pressure pulsation of the fuel resulting from the reciprocating motion of the plunger 102 in the high-pressure pump 91 is prevented from being transmitted to the second delivery pipes 68, 69 through the low-pressure fuel feed system 81.

More specifically, when the high-pressure pump 91 is in a non-energized condition, the fuel pressure pulsation caused by the reciprocating motion of the plunger 102 is damped due to pressure losses while the fuel passes through the low-pressure fuel feed pipe 85 and low-pressure fuel branch pipes 86, 87 having suitably set lengths, and the pressure pulsation is prevented from being transmitted to the second delivery pipes 68, 69. The period or cycle of the fuel pulsation caused by the reciprocating motion of the plunger 102 changes depending on the speed of the reciprocating motion of the plunger 102, namely, the engine speed. The length of the fuel passage required for damping the pressure pulsation in the low-pressure fuel feed system 81 is proportional to the pulsation period, and the length of the fuel passage needs to be increased as the engine speed is reduced and the pulsation period becomes longer (i.e., the pulsation frequency becomes lower). In the first embodiment, the length of the fuel passage from the inlet 105 of the high-pressure pump 91 to the first delivery pipes 64, 65 is set to be equal to or larger than the length with which the pressure pulsation can be damped at the idling speed (e.g., 500-800 rpm) as the lower-limit speed of the engine.

In the first embodiment, the fuel tank 83 is installed in a rear portion of the vehicle, and the engine is installed in a front portion of the vehicle, while the feed pump 84 is installed in a rear portion of the vehicle, and the high-pressure pump 91 is installed in a front portion of the vehicle. With this arrangement, the fuel passage from the inlet 105 of the high-pressure pump 91 to the first delivery pipes 64, 65, namely, the fuel passage from the feed pump 84 to the first delivery pipes 64, 65, has a sufficiently large length.

In the internal combustion engine of the first embodiment, the low-pressure fuel feed system 81 is provided for feeding the low-pressure fuel pressurized by the feed pump 84 to the first delivery pipes 64, 65 through the low-pressure fuel feed pipe 85 and the low-pressure fuel branch pipes 86, 87, and the high-pressure fuel feed system 82 is provided for feeding the high-pressure fuel delivered from the high-pressure pump 91 that pressurizes the low-pressure fuel, to the second delivery pipes 68, 69, through the high-pressure fuel feed pipe 92. In the engine of the first embodiment, the second injectors 66, 67 capable of injecting the high-pressure fuel to the combustion chambers 22, 23 are mounted to the second delivery pipes 68, 69, and the bypass pipe 97 is provided for communicating the first delivery pipe 65 with the second delivery pipe 68. In addition, the check valve 98 is provided in the bypass pipe 97 for preventing flow of the fuel from the second delivery pipe 68 to the first delivery pipe 65.

With the above arrangement in which the first delivery pipe 65 and second delivery pipe 68 having relatively large volumes communicate with each other via the bypass pipe 97, when the high-pressure pump 91 is in a non-driven or non-energized condition, the fuel pressure pulsation generated by the plunger 102 that is driven by the exhaust camshaft 35 is effectively damped while the fuel is passing through the low-pressure fuel feed pipe 85, low-pressure fuel branch pipes 86, 87 and the first delivery pipes 64, 65, and is prevented from being transmitted to the second delivery pipes 66, 67. Thus, an appropriate amount of fuel is supplied to each of the second injectors 66, 67, so that the second injector 66, 67 can inject a specified amount of low-pressure fuel into the corresponding combustion chamber 22, 23. Consequently, an otherwise possible deviation of the air/fuel ratio from a target or desired value can be reduced or eliminated.

In this case, the valve-opening pressure at which the check valve 98 opens to allow flow of the fuel from the first delivery pipe 65 to the second delivery pipe 68 is set to be lower than the delivery pressure of the low-pressure fuel when delivered by the feed pump 84. Accordingly, reverse flow of the low-pressure fuel from the second delivery pipe 68 to the first delivery pipe 65 through the bypass pipe 97 can be prevented, and the pressure of the low-pressure fuel fed to the second delivery pipes 68, 69 can be kept at a suitable pressure level.

In the first embodiment, the valve-opening pressure of the high-pressure fuel check valve 93 provided in the high-pressure fuel feed pipe 92, i.e., the pressure at which the check valve 93 opens to allow flow of the fuel from the high-pressure pump 91 to the high-pressure fuel feed pipe 92, is set to be higher than the delivery pressure of the low-pressure fuel when delivered by the feed pump 84. In this case, it is desirable that -the valve-opening pressure at which the high-pressure fuel check valve 93 opens to allow flow of the fuel from the high-pressure pump 91 to the high-pressure fuel feed pipe 92 is set to be higher than the maximum fuel pressure (the highest level of the pulsating fuel pressure) developed by the operation of the plunger 102 while the high-pressure pump 91 does not perform high-pressure fuel pressure control (i.e., during non-energization of the high-pressure pump 91).

While the engine is in a normal operating condition, therefore, the high-pressure pump 91 is driven to raise the pressure of the low-pressure fuel to provide high-pressure fuel having a suitably controlled pressure, so that the high-pressure fuel opens the high-pressure fuel check valve 93, and is fed to the second delivery pipes 68, 69 via the high-pressure fuel feed pipe 92. If the high-pressure pump 91 stops pressurizing the low-pressure fuel, on the other hand, the high-pressure fuel check valve 93 is closed, and the feeding of the high-pressure fuel to the second delivery pipes 68, 69 through the high-pressure fuel feed pipe 92 is stopped. As a result, the low-pressure fuel pressurized by the feed pump 84 can be fed to the second delivery pipes 68, 69 through the low-pressure fuel feed system 81 and the bypass pipe 97, while bypassing the high-pressure pump 91. Since the high-pressure fuel check valve 93 is closed at this time, and the valve-opening pressure of the check valve 93 is set to be higher than the pulsating fuel pressure developed by the operation of the plunger 102, the fuel pressure pulsation generated by the plunger 102 of the high-pressure pump 91 is prevented from being transmitted to the second delivery pipes 68, 69.

In the first embodiment, at least one pulsation reducing device for reducing pulsation of the fuel is provided in the low-pressure fuel feed pipe 85 and the low-pressure branch pipes 86, 87, and the pulsation reducing device is provided by setting the length of the fuel passage from the inlet 105 of the high-pressure pump 91 to the first delivery pipes 64, 65 to the length with which the fuel pulsation that occurs due to the operation of the high-pressure pump 91 (the plunger 102) is not transmitted to the first delivery pipes 64, 65. Accordingly, when the high-pressure pump 91 stops pressuring the low-pressure fuel, the fuel pressure pulsation produced by the plunger 102 of the high-pressure pump 91 is damped due to pressure losses while the pulsation propagates through the low-pressure fuel feed system 81, and the fuel pressure pulsation is effectively prevented from being transmitted to the second delivery pipes 68, 69.

Also, in the first embodiment, when the high-pressure pump 91 stops pressurizing the low-pressure fuel, the high-pressure fuel check valve 93 is closed, and the low-pressure fuel pressurized by the feed pump 84 is fed to the second delivery pipes 68, 69 through the low-pressure fuel feed system 81 and the bypass pipe 97. During the feeding of the low-pressure fuel, the fuel pressure pulsation produced by the plunger 102 of the high-pressure pump 91 is damped. Accordingly, substantially no variations or fluctuations in the fuel pressure appear and a stable fuel pressure can be established in the second delivery pipes 68, 69, thus enabling each of the second injectors 66, 68 to inject a specified amount of low-pressure fuel with high accuracy.

Figure 5:
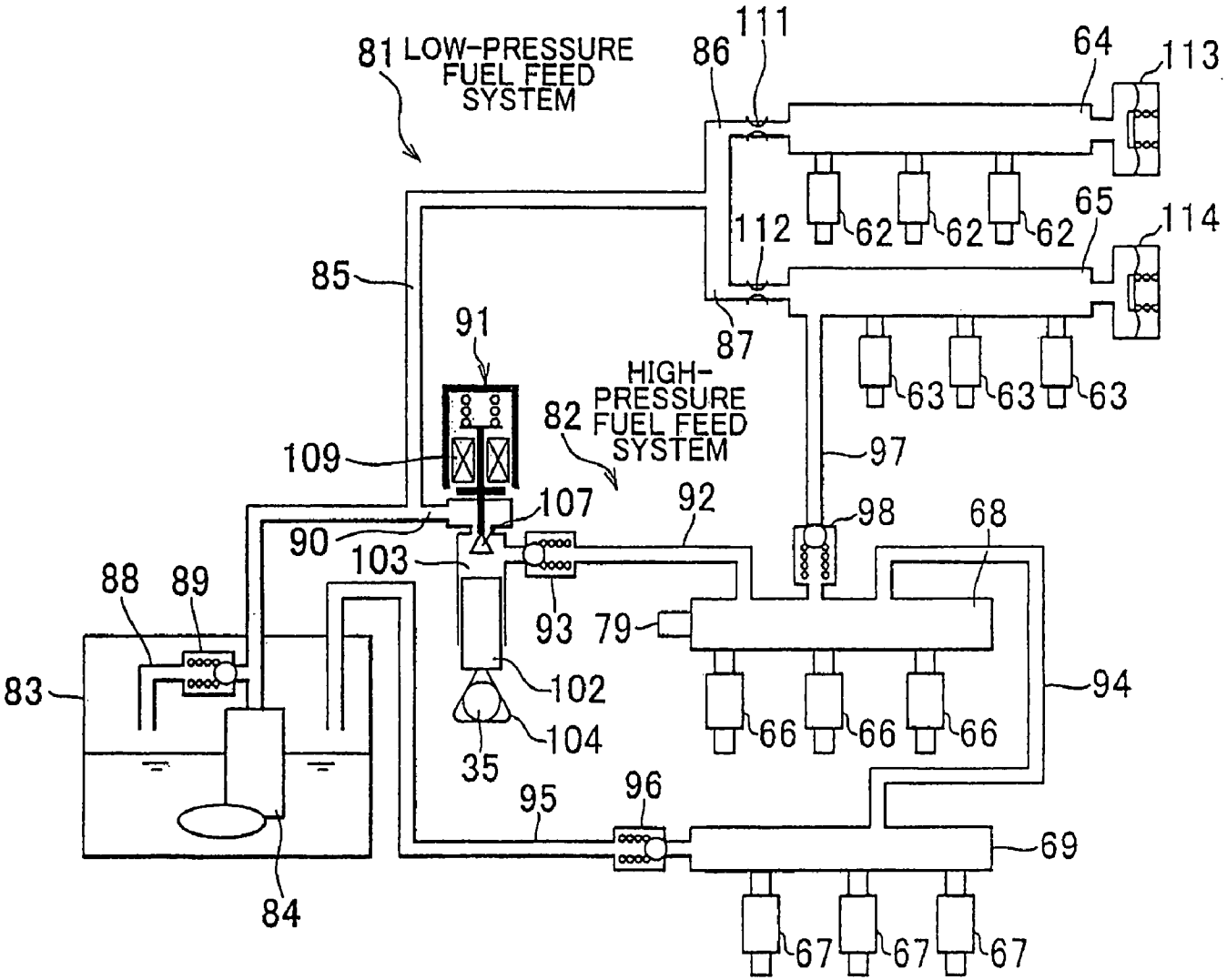
FIG. 5 is a schematic view showing a fuel system of an internal combustion engine according to a second embodiment of the invention.

FIG. 5 is a schematic view showing a fuel system of an internal combustion engine according to a second embodiment of the invention. In FIG. 5, the same reference numerals as used in FIG. 1 are used for identifying members or elements having the same or similar functions as those of the first embodiment as described above.

In the V-type six-cylinder gasoline engine of the second embodiment, the low-pressure fuel feed system 81 includes the feed pump 84 housed in the fuel tank 83, and the feed pump 84 is connected to the first delivery pipes 64, 65 via the low-pressure fuel feed pipe 85 and the low-pressure fuel branch pipes 86, 87, as shown in FIG. 5. The first injectors 62, 63 are mounted to the first delivery pipes 64, 65.

In the high-pressure fuel feed system 82, on the other hand, the branch pipe 90 is joined to a midstream portion of the low-pressure fuel feed pipe 85 in the low-pressure fuel feed system 81, and the high-pressure pump 91 is joined to the branch pipe 90. The second delivery pipe 68 is connected to the high-pressure pump 91 via the high-pressure fuel feed pipe 92, and the high-pressure fuel check valve 93 is mounted in the high-pressure fuel feed pipe 92. Also, the high-pressure feed pipe 92 is connected to the second delivery pipe 69 via the high-pressure fuel communicating pipe 94, and the second delivery pipe 69 is connected to the fuel tank 83 via the high-pressure fuel return pipe 95, while the relief valve 96 is mounted in the high-pressure fuel return pipe 95.

In addition, the bypass pipe 97 is provided for connecting the first delivery pipe 65 of the low-pressure fuel feed system 81 with the second delivery pipe 68 of the high-pressure fuel feed system 82, and the check valve 98 for preventing flow of fuel from the second delivery pipe 68 to the first delivery pipe 65 is mounted in the bypass pipe 97. In this case, the valve-opening pressure at which the check valve 98 opens to allow flow of the fuel from the first delivery pipe 65 to the second delivery pipe 68 is set to be lower than the delivery pressure at which the low-pressure fuel is delivered by the feed pump 84.

On the other hand, the valve-opening pressure of the high-pressure fuel check valve 93 provided in the high-pressure fuel feed pipe 92, i.e., the pressure at which the check valve 93 opens to allow flow of the fuel from the high-pressure pump 91 to the high-pressure fuel feed pipe 92, is set to be higher than the delivery pressure of the low-pressure fuel when delivered by the feed pump 84. It is, however, desirable that the valve-opening pressure of the high-pressure fuel check valve 93 is set to be higher than the maximum fuel pressure (the highest level of the pulsating fuel pressure) developed by the operation of the plunger 102 while the high-pressure pump 91 does not perform high-pressure fuel pressure control (i.e., during non-energization of the high-pressure pump 91).

In the second embodiment, two pulsation reducing devices for reducing pulsation of the fuel are provided in the low-pressure fuel feed pipe 85 and the low-pressure fuel branch pipes 86, 87. More specifically, restrictors 111, 112 serving as a pulsation reducing device are provided in the low-pressure fuel branch pipes 86, 87. Also, pulsation dampers 113, 114 for damping pulsation of the fuel are provided as a pulsation reducing device in end portions of the first delivery pipes 64, 65. The restrictors 111, 112 serve to reduce the areas (or inside diameters) of the fuel passages of the low-pressure fuel branch pipes 86, 87, respectively. The pulsation dampers 113, 114 consist of diaphragms and bias springs housed in cases connected to the end portions of the first delivery pipes 64, 65.

When the V-type six-cylinder engine of the second embodiment runs at idle after it has been warmed up, the electromagnetic spill valve 107 of the high-pressure pump 91 is stopped at the valve-open position, and the low-pressure fuel pressurized by the feed pump 84 is fed under pressure to the second delivery pipes 68, 69 while bypassing the high-pressure pump 91, so that the second injectors 66, 67 inject the low-pressure fuel into the combustion chambers 22, 23.

More specifically, when the engine runs at idle after being warmed up, application of current to the high-pressure pump 91 (or energization of the high-pressure pump 91) is stopped, and the electromagnetic spill valve 107 is stopped at the valve-open position. Then, the low-pressure fuel pressurized by the feed pump 84 is fed from the low-pressure fuel feed pipe 85 to the first delivery pipes 64, 65 through the low-pressure fuel branch pipes 86, 87, and is further fed to the second delivery pipes 68, 69 through the bypass pipe 97 and the check valve 98. Namely, the low-pressure fuel pressurized by the feed pump 84 is fed under pressure to the second delivery pipes 68, 69 while bypassing the high-pressure pump 91, so that the second injectors 66, 67 can inject the low-pressure fuel into the combustion chambers 22, 23.

Since the energization of the high-pressure pump 91 is stopped and the electromagnetic spill valve 107 is held in the valve-open condition during idling of the engine after its warm-up, the operating sound that would be produced upon opening and closing of the electromagnetic spill valve 107 is reduced or eliminated. Also, since the valve-opening pressure of the high-pressure fuel check valve 93 is set to be higher than the pulsating fuel pressure developed through the operation of the plunger 102 during non-energization of the high-pressure pump 91, the high-pressure fuel check valve 93 does not open when receiving the pulsating fuel pressure resulting from the reciprocating motion of the plunger 102. Thus, during non-energization of the high-pressure pump 91, the fuel pressure pulsation caused by the reciprocating motion of the plunger 102 is prevented from being transmitted to the second delivery pipes 68, 69 through the high-pressure fuel feed pipe 92.

When the high-pressure pump 91 is in a non-energized condition, the low-pressure fuel is fed to the first delivery pipes 64, 65 through the low-pressure fuel feed pipe 85 and the low-pressure fuel branch pipes 86, 87. During the feeding of the fuel, the fuel pressure pulsation caused by the reciprocating motion of the plunger 102 is damped due to pressure losses while the fuel is passing through the restrictors 111, 112 of the low-pressure fuel branch pipes 86, 87, and is further damped by the pulsation dampers 113, 114 in the first delivery pipes 64, 65, whereby the pressure pulsation is prevented from being transmitted to the second delivery pipes 68, 69.

Thus, in the internal combustion engine of the second embodiment, the first delivery pipe 65 and the second delivery pipe 68 communicate with each other via the bypass pipe 97, and the check valve 98 for preventing flow of the fuel from the second delivery pipe 68 to the first delivery pipe 65 is provided in the bypass pipe 97. Furthermore, the restrictors 111, 112 are provided in the low-pressure fuel branch pipes 86, 87, and the pulsation dampers 113, 114 are provided in the end portions of the first delivery pipes 64, 65.

With the above arrangement, when the high-pressure pump 91 is in a non-driven condition, the fuel pressure pulsation produced by the plunger 102 that is driven by the exhaust camshaft 35 is damped by the restrictors 111, 112 when the fuel passes through the low-pressure fuel branch pipes 86, 87, and is damped by the pulsation dampers 113, 114 when the fuel reaches the first delivery pipes 64, 65. Thus, the fuel pressure pulsation is prevented from being transmitted to the second delivery pipes 68, 69, and an appropriate amount of fuel is supplied to each of the second injectors 66, 67 so that the second injector 66, 67 can inject a specified amount of low-pressure fuel into the corresponding combustion chamber 22, 23. Consequently, an otherwise possible deviation of the air/fuel ratio from a target or desired value can be reduced or eliminated.

Figure 6:
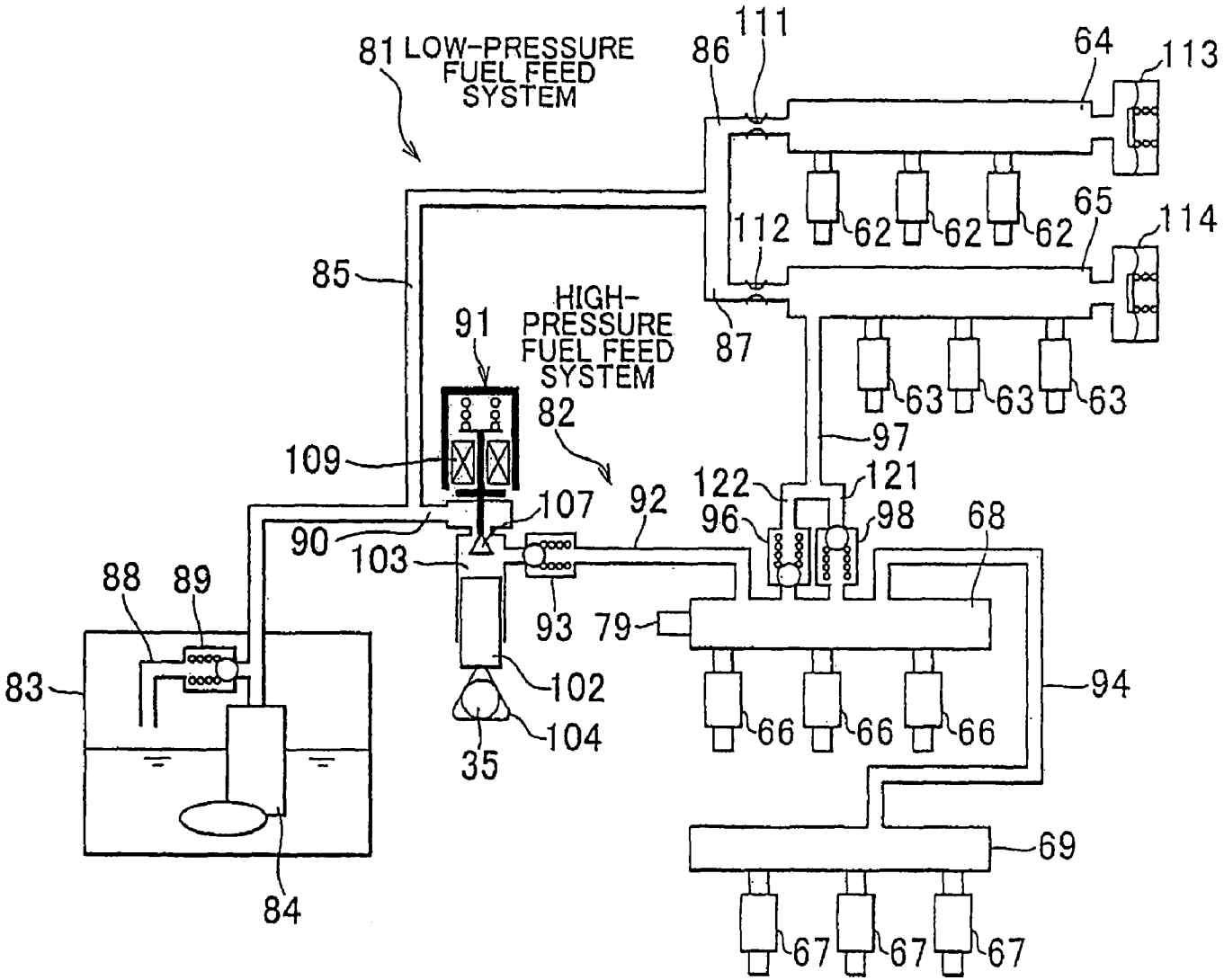
FIG. 6 is a schematic view showing a fuel system of an internal combustion engine according to a third embodiment of the invention.

FIG. 6 is a schematic view showing a fuel system of an internal combustion engine according to a third embodiment of the invention. In FIG. 6, the same reference numerals as used in FIG. 1 and FIG. 5 are used for identifying members or elements having the same or similar functions as those of the first and second embodiments as described above.

In the V-type six-cylinder gasoline engine of the third embodiment, the low-pressure fuel feed system 81 includes the feed pump 84 housed in the fuel tank 83, and the feed pump 84 is connected to the first delivery pipes 64, 65 via the low-pressure fuel feed pipe 85 and the low-pressure fuel branch pipes 86, 87, as shown in FIG. 6. The first injectors 62, 63 are mounted to the first delivery pipes 64, 65.

In the high-pressure fuel feed system 82, on the other hand, the branch pipe 90 is joined to a midstream portion of the low-pressure fuel feed pipe 85 in the low-pressure fuel feed system 81, and the high-pressure pump 91 is joined to the branch pipe 90. The high-pressure pump 91 is connected to the second delivery pipe 68 via the high-pressure fuel feed pipe 92, and the high-pressure fuel check valve 93 is mounted in the high-pressure fuel feed pipe 92. Also, the high-pressure fuel feed pipe 92 is connected to the second delivery pipe 69 via the high-pressure fuel communicating pipe 94.

In addition, the bypass pipe 97 is provided for connecting the first delivery pipe 65 of the low-pressure fuel feed system 81 with the second delivery pipe 68 of the high-pressure fuel feed system 82. The bypass pipe 97 is joined at one end to the first delivery pipe 65, and the other end portion of the bypass pipe 97 is split into a first branch pipe 121 and a second branch pipe 122, which are joined to the second delivery pipe 68. A check valve 98 for preventing flow of the fuel from the second delivery pipe 68 to the first delivery pipe 65 is mounted in the first branch pipe 121. In the second branch pipe 122 is mounted a relief valve 96 that is opened when the pressure of the high-pressure fuel in the second delivery pipe 68 exceeds a predetermined pressure level, so as to return the fuel to the first delivery pipe 65. In this case, the valve-opening pressure of the check valve 98, i.e., the pressure at which the check valve 98 opens to allow flow of the fuel from the first delivery pipe 65 to the second delivery pipe 68, is set to be lower than the delivery pressure of the low-pressure fuel when delivered by the feed pump 84.

In the third embodiment, the restrictors 111, 112 are provided in the low-pressure fuel branch pipes 86, 87, and the pulsation dampers 113, 114 are provided in the end portions of the first delivery pipes 64, 65.

When the V-type six-cylinder engine of the third embodiment is started, the feed pump 84 is driven to pump up the fuel in the fuel tank 83 and raise the pressure of the fuel to a certain pressure level, and delivers the resulting low-pressure fuel to the low-pressure fuel feed pipe 85. In the low-pressure fuel feed system 81, the low-pressure fuel-is fed from the low-pressure fuel feed pipe 85 to the first delivery pipes 64, 65 through the low-pressure fuel branch pipes 86, 87, such that the pressure of the fuel in the first delivery pipes 64, 65 is kept at a specified low pressure by means of the regulator 89.

In the high-pressure fuel feed system 82, on the other hand, the low-pressure fuel delivered from the feed pump 84 to the low-pressure fuel feed pipe 85 is fed to the high-pressure pump 91 through the branch pipe 90, and the high-pressure pump 91 raises the pressure of the low-pressure fuel to a certain pressure level to provide high-pressure fuel. Then, the high-pressure fuel opens the high-pressure fuel check valve 93, and is fed to the second delivery pipe 68 through the high-pressure fuel feed pipe 92, and is further fed to the second delivery pipe 69 through the high-pressure fuel communicating pipe 94. If the fuel pressure in the second delivery pipes 68, 69 exceeds a predetermined pressure during the feeding of the high-pressure fuel, the relief valve 96 opens, and the high-pressure fuel in the second delivery pipes 68, 69 is discharged to the first delivery pipes 64, 65 through the relief valve 96, second branch pipe 122 and the bypass pipe 97, so that the pressure of the fuel in the second delivery pipes 68, 69 is kept at the predetermined pressure level.

When the engine runs at idle after it has been warmed up, the electromagnetic spill valve 107 of the high-pressure pump 91 is stopped at the valve-open position, and the low-pressure fuel pressurized by the feed pump 84 is fed under pressure to the second delivery pipes 68, 69 while bypassing the high-pressure pump 91, so that the second injectors 66, 67 inject the low-pressure fuel into the combustion chambers 22, 23.

More specifically, when the engine runs at idle after it has been warmed up, application of current to the high-pressure pump 91 (or energization of the high-pressure pump 91) is stopped, so that the electromagnetic spill valve 107 is stopped at the valve-open position. Then, the low-pressure fuel pressurized by the feed pump 84 is fed from the low-pressure fuel feed pipe 85 to the first delivery pipes 64, 65 through the low-pressure fuel branch pipes 86, 87, and is fed to the second delivery pipes 68, 69 through the bypass pipe 97, first branch pipe 121 and the check valve 98. Namely, the low-pressure fuel pressurized by the feed pump 84 is fed under pressure to the second delivery pipes 68, 69 while bypassing the high-pressure pump 91, so that the second injectors 66, 67 can inject the low-pressure fuel into the combustion chambers 22, 23.

Since the energization of the high-pressure pump 91 is stopped and the electromagnetic spill valve 107 is held in a valve-open condition during idling of the engine after its warm-up, the operating sound that would be produced upon opening and closing of the electromagnetic spill valve 107 is reduced or eliminated. Also, since the valve-opening pressure of the high-pressure fuel check valve 93 is set to be higher than the pulsating fuel pressure developed by the operation of the plunger 102 during non-energization of the high-pressure pump 91, the high-pressure fuel check valve 93 does not open when receiving the pulsating fuel pressure resulting from the reciprocating motion of the plunger 102. Thus, during non-energization of the high-pressure pump 91, the pressure pulsation of the fuel caused by the reciprocating motion of the plunger 102 is prevented from being transmitted to the second delivery pipes 68, 69 through the high-pressure fuel feed pipe 92.

When the high-pressure pump 91 is in a non-energized condition, the low-pressure fuel is fed to the first delivery pipes 64, 65 through the low-pressure fuel feed pipe 85 and the low-pressure fuel branch pipes 86, 87. During the feeding of the fuel, the pressure pulsation of the fuel resulting from the reciprocating motion of the plunger 102 is damped due to pressure losses while the fuel is passing through the restrictors 111, 112 of the low-pressure fuel branch pipes 86, 87, and is also damped by the pulsation dampers 113, 114 in the first delivery pipes 64, 65. Thus, transmission or propagation of the pressure pulsation to the second delivery pipe 68, 69 is restricted or prevented.

Thus, in the internal combustion engine of the third embodiment, the first delivery pipe 65 and the second delivery pipe 68 communicate with each other via the bypass pipe 97, and one end portion of the bypass pipe 97 is split into the first branch pipe 121 and the second branch pipe 122. The check valve 98 is mounted in the first branch pipe 121, and the relief valve 96 is mounted in the second branch pipe 122.

With the above arrangement, when the high-pressure pump 91 is in a driven condition, the high-pressure fuel is fed to the second delivery pipes 68, 69 through the high-pressure fuel feed pipe 92, and the relief valve 96 opens if the fuel pressure in the second delivery pipes 68, 69 exceeds a predetermined pressure level, so that the high-pressure fuel in the second delivery pipes 68, 69 can be discharged to the first delivery pipes 64, 65 through the bypass pipe 97. In this manner, the pressure of the fuel in the second delivery pipes 68, 69 can be kept at the predetermined pressure level. When the high-pressure pump 91 is in a non-driven condition, on the other hand, the low-pressure fuel pressurized by the feed pump 84 is fed to the first delivery pipes 64, 65 through the low-pressure fuel feed pipe 85, and is further fed to the second delivery pipes 68, 69 through the bypass pipe 97 and the check valve 98. At this time, the pressure pulsation of the fuel produced by the plunger 102 that is driven by the exhaust camshaft 35 is damped by the restrictors 111, 112 and the pulsation dampers 113, 114, so that transmission of the fuel pressure pulsation to the second delivery pipes 68, 69 can be effectively restricted or prevented.

In this embodiment in which the bypass pipe 97 serves as a fuel return passage as well as a bypass passage, the number of pipes used in the fuel system can be reduced, and the fuel system can be simply constructed at a reduced cost.

Figure 7:
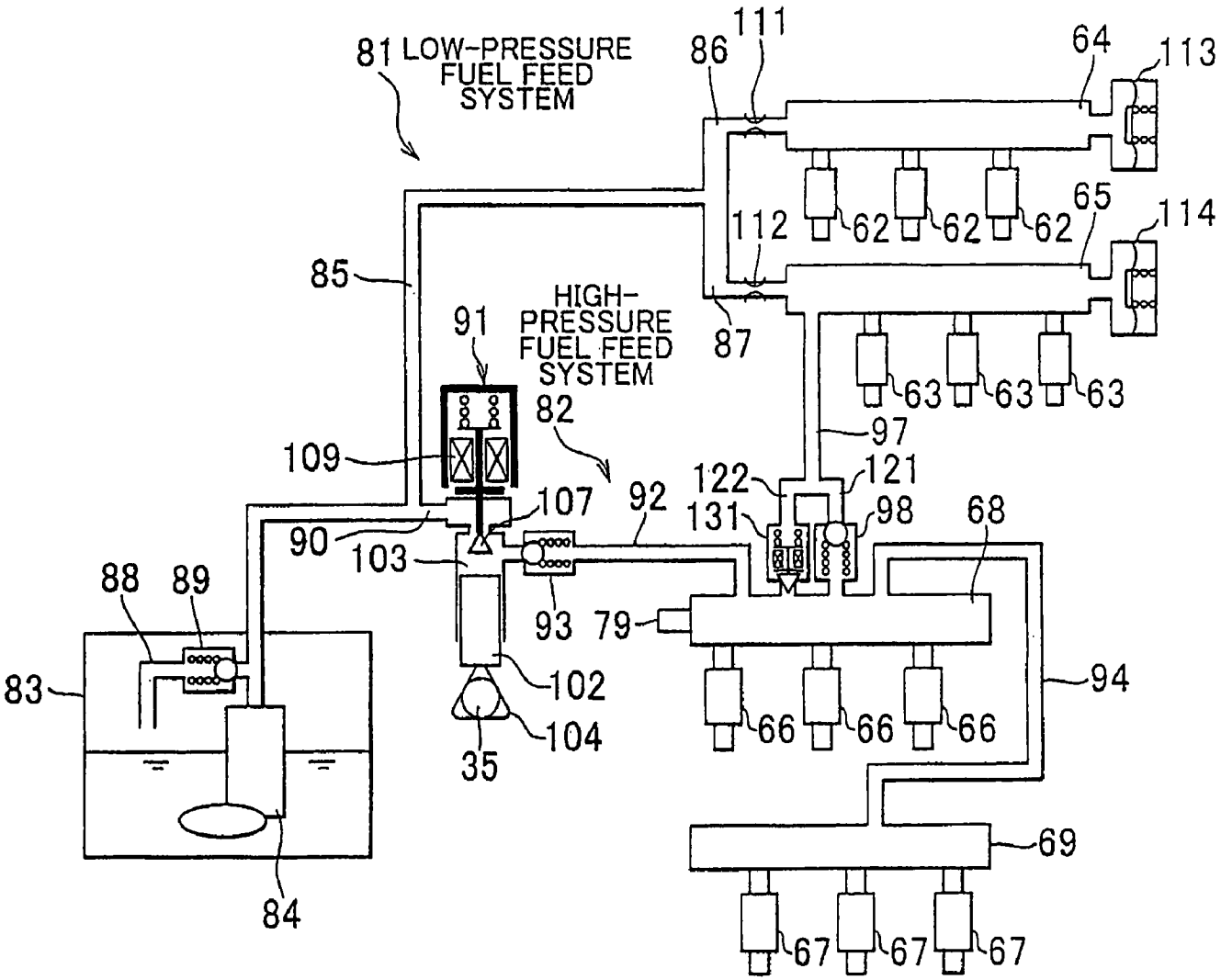
FIG. 7 is a schematic view showing a fuel system of an internal combustion engine according to a fourth embodiment of the invention.

FIG. 7 is a schematic view showing a fuel system of an internal combustion engine according to a fourth embodiment of the invention. In FIG. 7, the same reference numerals as used in FIG. 1, FIG. 5 and FIG. 6 are used for identifying members or elements having the same or similar functions as those of the illustrated embodiments.

In the V-type six-cylinder gasoline engine of the fourth embodiment, the low-pressure fuel feed system 81 includes the feed pump 84 housed in the fuel tank 83, and the feed pump 84 is connected to the first delivery pipes 64, 65 via the low-pressure fuel feed pipe 85 and the low-pressure fuel branch pipes 86, 87, as shown in FIG. 7. The first injectors 62, 63 are mounted to the first delivery pipes 64, 65.

In the high-pressure fuel feed system 82, on the other hand, the branch pipe 90 is joined to a midstream portion of the low-pressure fuel feed pipe 85 in the low-pressure fuel feed system 81, and the high-pressure pump 91 is joined to the branch pipe 90. The high-pressure pump 91 is connected to the second delivery pipe 68 via the high-pressure fuel feed pipe 92, and the high-pressure fuel check valve 93 is mounted in the high-pressure fuel feed pipe 92. Also, the high-pressure fuel feed pipe 92 is connected to the second delivery pipe 69 via the high-pressure fuel communicating pipe 94.

In addition, the bypass pipe 97 is provided for connecting the first delivery pipe 65 of the low-pressure fuel feed system 81 with the second delivery pipe 68 of the high-pressure fuel feed system 82. The bypass pipe 97 is joined at one end to the first delivery pipe 65, and the other end portion of the bypass pipe 97 is split into a first branch pipe 121 and a second branch pipe 122, which are joined to the second delivery pipe 68. A check valve 98 for preventing flow of the fuel from the second delivery pipe 68 to the first delivery pipe 65 is mounted in the first branch pipe 121. In the second branch pipe 122 is mounted an electromagnetic relief valve 131 that is opened when the pressure of the high-pressure fuel in the second delivery pipe 68 exceeds a predetermined pressure level, so as to return the fuel to the first delivery pipe 65. In this case, the valve-opening pressure of the check valve 98 at which the check valve 98 opens to allow flow of the fuel from the first delivery pipe 65 to the second delivery pipe 68 is set to be lower than the delivery pressure of the low-pressure fuel when delivered by the feed pump 84. The ECU 72 is able to control opening of the electromagnetic relief valve 131 in accordance with the engine operating conditions.

In the fourth embodiment, restrictors 111, 112 are respectively provided in the low-pressure fuel branch pipes 86, 87, and pulsation dampers 113, 114 are provided in respective end portions of the first delivery pipes 64, 65.

When the V-type six-cylinder engine of the fourth embodiment is started, the feed pump 84 is driven to pump up the fuel in the fuel tank 83 and raise the pressure of the fuel to a certain pressure level, and delivers the resulting low-pressure fuel to the low-pressure fuel feed pipe 85. In the low-pressure fuel feed system 81, the low-pressure fuel is fed from the low-pressure fuel feed pipe 85 to the first delivery pipes 64, 65 through the low-pressure fuel branch pipes 86, 87, such that the pressure of the fuel in the first delivery pipes 64, 65 is kept at a specified low pressure by means of the regulator 89.

In the high-pressure fuel feed system 82, on the other hand, the low-pressure fuel delivered from the feed pump 84 to the low-pressure fuel feed pipe 85 is fed to the high-pressure pump 91 through the branch pipe 90, and the high-pressure pump 91 raises the pressure of the low-pressure fuel to a certain pressure level to provide high-pressure fuel. Then, the high-pressure fuel opens the high-pressure fuel check valve 93, and is fed to the second delivery pipe 68 through the high-pressure fuel feed pipe 92, and is further fed to the second delivery pipe 69 through the high-pressure fuel communicating pipe 94. During the feeding, the ECU 72 monitors the pressure of the fuel in the second delivery pipe 68 using the fuel pressure sensor 79. If the fuel pressure in the second delivery pipes 68, 69 detected by the fuel pressure sensor 79 exceeds a predetermined pressure level, the ECU 72 opens the electromagnetic relief valve 131, so that the high-pressure fuel in the second delivery pipes 68, 69 is discharged to the first delivery pipes 64, 65 through the electromagnetic relief valve 131, second branch pipe 122 and the bypass pipe 97. In this manner, the pressure of the fuel in the second delivery pipes 68, 69 is kept at the predetermined pressure level.

When the engine runs at idle after it has been warmed up, the electromagnetic spill valve 107 of the high-pressure pump 91 is stopped at the valve-open position, and the low-pressure fuel pressurized by the feed pump 84 is fed under pressure to the second delivery pipes 68, 69 while bypassing the high-pressure pump 91, so that the second injectors 66, 67 inject the low-pressure fuel into the combustion chambers 22, 23.

More specifically, when the engine runs at idle after its warm-up, application of current to the high-pressure pump 91 (or energization of the high-pressure pump 91) is stopped, so that the electromagnetic spill valve 107 is stopped at the valve-open position. Then, the low-pressure fuel pressurized by the feed pump 84 is fed from the low-pressure fuel feed pipe 85 to the first delivery pipes 64, 65 through the low-pressure fuel branch pipes 86, 87, and is fed to the second delivery pipes 68, 69 through the bypass pipe 97, first branch pipe 121 and the check valve 98. Namely, the low-pressure fuel pressurized by the feed pump 84 is fed under pressure to the second delivery pipes 68, 69 while bypassing the high-pressure pump 91, so that the second injectors 66, 67 can inject the low-pressure fuel into the combustion chambers 22, 23.

Since the energization of the high-pressure pump 91 is stopped and the electromagnetic spill valve 107 is held in a valve-open condition during idling of the engine after its warm-up, the operating sound that would be produced upon opening and closing of the electromagnetic spill valve 107 is reduced or eliminated. Also, since the valve-opening pressure of the high-pressure fuel check valve 93 is set to be higher than the pulsating fuel pressure developed by the operation of the plunger 102 during non-energization of the high-pressure pump 91, the high-pressure fuel check valve 93 does not open in response to the pulsating fuel pressure resulting from the reciprocating motion of the plunger 102. Thus, during non-energization of the high-pressure pump 91, the pressure pulsation of the fuel caused by the reciprocating motion of the plunger 102 is prevented from being transmitted to the second delivery pipes 68, 69 through the-high-pressure fuel feed pipe 92.

When the high-pressure pump 91 is in a non-energized condition, the low-pressure fuel is fed to the first delivery pipes 64, 65 through the low-pressure fuel feed pipe 85 and the low-pressure fuel branch pipes 86, 87. During the feeding of the fuel, the pressure pulsation of the fuel caused by the reciprocating motion of the plunger 102 is damped due to pressure losses while the fuel is passing through the restrictors 111, 112 of the low-pressure fuel branch pipes 86, 87, and is also damped by the pulsation dampers 113, 114 in the first delivery pipes 64, 65. Thus, transmission or propagation of the pressure pulsation to the second delivery pipe 68, 69 is restricted or prevented.

Thus, in the internal combustion engine of the fourth embodiment, the first delivery pipe 65 and the second delivery pipe 68 communicate with each other via the bypass pipe 97, and one end portion of the bypass pipe 97 is split into the first branch pipe 121 and the second branch-pipe 122. The check valve 98 is mounted in the first branch pipe 121, and the electromagnetic relief valve 131 is mounted in the second branch pipe 122.

With the above arrangement, when the high-pressure pump 91 is in a driven condition, the high-pressure fuel is fed to the second delivery pipes 68, 69 through the high-pressure fuel feed pipe 92, and the ECU 72 opens the electromagnetic relief valve 131 if the fuel pressure in the second delivery pipes 68, 69 detected by the fuel pressure sensor 79 exceeds a predetermined pressure level, so that the high-pressure fuel in the second delivery pipes 68, 69 is discharged to the first delivery pipes 64, 65 through the bypass pipe 97. In this manner, the pressure of the fuel in the second delivery pipes 68, 69 can be kept at the predetermined pressure level. When the high-pressure pump 91 is in a non-driven condition, on the other hand, the low-pressure fuel pressurized by the feed pump 84 is fed to the first delivery pipes 64, 65 through the low-pressure fuel feed pipe 85, and is further fed to the second delivery pipes 68, 69 through the bypass pipe 97 and the check valve 98. During the feeding of the low-pressure fuel, the pressure pulsation of the fuel produced by the plunger 102 that is driven by the exhaust camshaft 35 is damped by the restrictors 111, 112 and the pulsation dampers 113, 114, so that transmission of the fuel pressure pulsation to the second delivery pipes 68, 69 can be effectively restricted or prevented.

In this embodiment in which the bypass pipe 97 serves as a fuel return passage as well as a bypass passage, the number of pipes used in the fuel system can be reduced, and the fuel system can be simply constructed at a reduced cost. Also, since the electromagnetic relief valve 131 is provided in the bypass passage 97, the fuel pressure in the second delivery pipes 68, 69 is prevented from being reduced due to pressure losses when the high-pressure fuel check valve 93 is opened, and variations in the fuel pressure due to hysteresis between the time when the check valve 93 is opened and the time when the check valve 93 is closed are reduced, thus assuring improved controllability of the fuel pressure.

In each of the illustrated embodiments, the ECU 72 brings the high-pressure pump 91 into a non-driven condition when the engine runs at idle after it has been warmed up, so that the low-pressure fuel pressurized by the feed pump 84 is fed to the first delivery pipes 64, 65 through the low-pressure fuel feed pipe 85, and is further fed to the second delivery pipes 68, 69 through the bypass pipe 97. It is, however, to be understood that the engine operating conditions in which the high-pressure pump 91 is placed in the non-driven condition are not limited to these conditions. For example, when the engine is started or when the engine runs at a high speed with a low load, the high-pressure pump 91 may be brought into a non-driven condition, and the low-pressure fuel may be supplied to the second delivery pipes 68, 69.

The invention may be applied to all types of fuel systems for feeding fuel to internal combustion engines, such as gasoline engines and diesel engines, installed on vehicles, such as passenger automobiles and trucks. It is also to be understood that the type of the engine to which the invention is applied is not limited to the V-type six-cylinder engine, but may be, for example, an in-line four-cylinder engine, and that the number of cylinders is not limited to that of each of the illustrated embodiments.

As is understood from the above description, the internal combustion engine according to the invention is arranged to communicate a low-pressure fuel passage with a high-pressure fuel passage via a bypass passage so as to effectively restrict or prevent propagation of fuel pressure pulsation caused by driving of the high-pressure pump, so that an appropriate amount of fuel can be supplied to the engine for improved control of the air/fuel ratio. The invention is applicable to the type of the engine in which the high-pressure pump is driven depending on the operating condition of the engine, and is particularly suitable for reducing an influence of the pressure pulsation produced by the high-pressure pump on the fuel system of the engine.

The invention claimed is:

1. An internal combustion engine, comprising:

a low-pressure fuel feed system that feeds a low-pressure fuel pressurized by a low-pressure pump to a low-pressure fuel volume chamber through a low-pressure fuel passage;

a low-pressure fuel injection device provided on the low-pressure fuel volume chamber for injecting the low-pressure fuel to an intake port;

a high-pressure fuel feed system that feeds a high-pressure fuel to a high-pressure fuel volume chamber through a high-pressure fuel passage, said high-pressure fuel feed system including a high-pressure pump that raises the pressure of the low-pressure fuel pressurized by the low-pressure pump to provide the high-pressure fuel;

a bypass passage that communicates the low-pressure fuel volume chamber with the high-pressure fuel feed system; and a check valve provided in the bypass passage for preventing flow of the fuel from the high-pressure fuel feed system to the low-pressure fuel volume chamber, wherein the bypass passage communicates the low-pressure fuel volume chamber with the high-pressure fuel passage and a valve-opening pressure of the check valve at which the check valve opens to allow flow of the fuel from the low-pressure fuel volume chamber to the high-pressure fuel feed system is set to be lower than a delivery pressure of the low-pressure fuel at which the low-pressure fuel is delivered by the low-pressure pump.

2. The internal combustion engine according to claim 1, wherein a high-pressure fuel check valve is provided for preventing reverse flow of the fuel from the high-pressure fuel feed system to the high-pressure pump, and a valve-opening pressure at which the high-pressure fuel check valve opens to allow flow of the fuel from the high-pressure pump to the high-pressure fuel passage is set to be higher than the delivery pressure at which the low-pressure fuel is delivered by the low-pressure pump.

3. The internal combustion engine according to claim 1, wherein a high-pressure fuel check valve is provided for preventing reverse flow of the fuel from the high-pressure fuel passage to the high-pressure pump;

the high-pressure pump includes a plunger that moves in accordance with driving of the internal combustion engine so as to raise the pressure of the low-pressure fuel to provide the high-pressure fuel, and a flow regulating valve that is opened and closed so as to draw in the low-pressure fuel and deliver the high-pressure fuel;

a valve-opening pressure at which the high-pressure fuel check valve opens to allow flow of the fuel from the high-pressure pump to the high-pressure fuel passage is set to be higher than a maximum fuel pressure developed by operation of the plunger while the high-pressure pump does not perform high-pressure fuel pressure control.

4. The internal combustion engine according to claim 1, wherein at least one pulsation reducing device that reduces pulsation of the fuel is provided in the low-pressure fuel passage.

5. The internal combustion engine according to claim 4, wherein said at least one pulsation reducing device comprises setting a length of a fuel passage from an inlet of the high-pressure pump to the low-pressure fuel volume chamber to a length with which fuel pulsation that occurs due to operation of the high-pressure pump is not transmitted to the low-pressure fuel volume chamber.

6. The internal combustion engine according to claim 4, wherein said at least one pulsation reducing device comprises a restrictor provided in the low-pressure fuel passage for reducing an area of the fuel passage.

7. The internal combustion engine according to claim 4, wherein said at least one pulsation reducing device comprises a damper provided in the low-pressure fuel passage for damping pulsation of the fuel.

8. The internal combustion engine according to claim 1, wherein the bypass passage has a first branch passage and a second branch passage, and the check valve is provided in the first branch passage while a relief valve is provided in the second branch passage, said relief valve being opened so as to return the fuel to the low-pressure fuel volume chamber when the pressure of the high-pressure fuel in the high-pressure fuel feed system exceeds a predetermined pressure level.

9. The internal combustion engine according to claim 8, wherein the relief valve comprises an electromagnetic valve whose opening can be electrically controlled.

10. An internal combustion engine, comprising:

a low-pressure fuel feed system that feeds a low-pressure fuel pressurized by a low-pressure pump to a low-pressure fuel volume chamber through a low-pressure fuel passage;

a low-pressure fuel injection device provided on the low-pressure fuel volume chamber for injecting the low-pressure fuel to an intake port;

a high-pressure fuel feed system that feeds a high-pressure fuel to a high-pressure fuel volume chamber through a high-pressure fuel passage, said high-pressure fuel feed system including a high-pressure pump that raises the pressure of the low-pressure fuel pressurized by the low-pressure pump to provide the high-pressure fuel;

a bypass passage that communicates the low-pressure fuel volume chamber with the high-pressure fuel feed system; and a check valve provided in the bypass passage for preventing flow of the fuel from the high-pressure fuel feed system to the low-pressure fuel volume chamber, wherein the bypass passage communicates the low-pressure fuel volume chamber with the high-pressure fuel volume chamber and a valve-opening pressure of the check valve at which the check valve opens to allow flow of the fuel from the low-pressure fuel volume chamber to the high-pressure fuel feed system is set to be lower than a delivery pressure of the low-pressure fuel at which the low-pressure fuel is delivered by the low-pressure pump.

11. The internal combustion engine according to claim 10, wherein a high-pressure fuel check valve is provided for preventing reverse flow of the fuel from the high-pressure fuel feed system to the high-pressure pump, and a valve-opening pressure at which the high-pressure fuel check valve opens to allow flow of the fuel from the high-pressure pump to the high-pressure fuel passage is set to be higher than the delivery pressure at which the low-pressure fuel is delivered by the low-pressure pump.

12. The internal combustion engine according to claim 10, wherein a high-pressure fuel check valve is provided for preventing reverse flow of the fuel from the high-pressure fuel passage to the high-pressure pump;

the high-pressure pump includes a plunger that moves in accordance with driving of the internal combustion engine so as to raise the pressure of the low-pressure fuel to provide the high-pressure fuel, and a flow regulating valve that is opened and closed so as to draw in the low-pressure fuel and deliver the high-pressure fuel;

a valve-opening pressure at which the high-pressure fuel check valve opens to allow flow of the fuel from the high-pressure pump to the high-pressure fuel passage is set to be higher than a maximum fuel pressure developed by operation of the plunger while the high-pressure pump does not perform high-pressure fuel pressure control.

13. The internal combustion engine according to claim 10, wherein at least one pulsation reducing device that reduces pulsation of the fuel is provided in the low-pressure fuel passage.

14. The internal combustion engine according to claim 13, wherein said at least one pulsation reducing device comprises setting a length of a fuel passage from an inlet of the high-pressure pump to the low-pressure fuel volume chamber to a length with which fuel pulsation that occurs due to operation of the high-pressure pump is not transmitted to the low-pressure fuel volume chamber.

15. The internal combustion engine according to claim 13, wherein said at least one pulsation reducing device comprises a restrictor provided in the low-pressure fuel passage for reducing an area of the fuel passage.

16. The internal combustion engine according to claim 13, wherein said at least one pulsation reducing device comprises a damper provided in the low-pressure fuel passage for damping pulsation of the fuel.

17. The internal combustion engine according to claim 10, wherein the bypass passage has a first branch passage and a second branch passage, and the check valve is provided in the first branch passage while a relief valve is provided in the second branch passage, said relief valve being opened so as to return the fuel to the low-pressure fuel volume chamber when the pressure of the high-pressure fuel in the high-pressure fuel feed system exceeds a predetermined pressure level.

18. The internal combustion engine according to claim 17, wherein the relief valve comprises an electromagnetic valve whose opening can be electrically controlled.

* * * * *